US011728569B2

(12) United States Patent
Avser et al.

(10) Patent No.: US 11,728,569 B2
(45) Date of Patent: Aug. 15, 2023

(54) ELECTRONIC DEVICES WITH DIELECTRIC RESONATOR ANTENNAS

(71) Applicant: Apple Inc., Cupertino, CA (US)

(72) Inventors: Bilgehan Avser, San Bruno, CA (US); Harish Rajagopalan, San Jose, CA (US); Simone Paulotto, Redwood City, CA (US); Jennifer M. Edwards, San Francisco, CA (US); Hao Xu, Cupertino, CA (US); Rodney A. Gomez Angulo, Santa Clara, CA (US); Matthew D. Hill, Santa Clara, CA (US); Mattia Pascolini, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 283 days.

(21) Appl. No.: 17/111,131

(22) Filed: Dec. 3, 2020

(65) Prior Publication Data

US 2021/0119338 A1 Apr. 22, 2021

Related U.S. Application Data

(62) Division of application No. 16/289,433, filed on Feb. 28, 2019, now Pat. No. 10,886,619.

(51) Int. Cl.

| | |
|---|---|
| ***H01Q 9/04*** | (2006.01) |
| ***H01Q 1/24*** | (2006.01) |
| ***H01Q 21/00*** | (2006.01) |

(52) U.S. Cl.

CPC ..... *H01Q 9/0485* (2013.01); *H01Q 1/243* (2013.01); *H01Q 21/0075* (2013.01)

(58) Field of Classification Search

None

See application file for complete search history.

(56) References Cited

U.S. PATENT DOCUMENTS

| | | | |
|---|---|---|---|
| 6,344,833 | B1 | 2/2002 | Lin et al. |
| 6,531,991 | B2 | 3/2003 | Adachi et al. |
| 6,768,454 | B2 | 7/2004 | Kingsley et al. |
| 6,995,715 | B2 | 2/2006 | Ying et al. |
| 7,405,697 | B2 | 7/2008 | Ying |
| 7,605,763 | B2 | 10/2009 | Finn et al. |

(Continued)

*Primary Examiner* — Crystal L Hammond

(74) *Attorney, Agent, or Firm* — Treyz Law Group, P.C.; Michael H. Lyons; Tianyi He

(57) ABSTRACT

An electronic device may be provided with a phased antenna array and a display cover layer. The phased antenna array may include a dielectric resonator antenna. The dielectric resonator antenna may include a dielectric resonating element embedded in a lower permittivity dielectric substrate. The substrate and the resonating element may be mounted to a flexible printed circuit. A slot may be formed in ground traces on the flexible printed circuit and aligned with the resonating element. The slot may excite resonant modes of the resonating element. The resonating element may convey corresponding radio-frequency signals through the cover layer. A dielectric matching layer may be interposed between the resonating element and the cover layer. If desired, the slot may radiate additional radio-frequency signals and the matching layer may have a tapered shape. Dielectric resonator antennas for covering different polarizations and frequencies may be interleaved across the array.

20 Claims, 17 Drawing Sheets

(56) References Cited

U.S. PATENT DOCUMENTS

| | | | | |
|---|---|---|---|---|
| 8,493,272 | B2 | 7/2013 | Ollikainen et al. | |
| 9,074,070 | B2 | 7/2015 | Yung et al. | |
| 9,667,290 | B2 | 5/2017 | Ouyang et al. | |
| 9,685,700 | B2 | 6/2017 | Komulainen et al. | |
| 9,831,562 | B2 | 11/2017 | Caratelli et al. | |
| 9,876,272 | B2 * | 1/2018 | Hu | H01Q 13/103 |
| 10,027,006 | B2 | 7/2018 | Cheng et al. | |
| 10,181,632 | B2 | 1/2019 | Cruickshank et al. | |
| 2002/0014996 | A1 | 2/2002 | Keilen | |
| 2004/0164907 | A1 * | 8/2004 | Killen | H01Q 9/0457 343/700 MS |
| 2014/0078008 | A1 | 3/2014 | Kang et al. | |
| 2014/0085163 | A1 | 3/2014 | Gregg | |
| 2014/0113828 | A1 | 4/2014 | Gilbert et al. | |
| 2015/0116159 | A1 | 4/2015 | Chen et al. | |
| 2016/0097833 | A1 | 4/2016 | Han et al. | |
| 2016/0204509 | A1 | 7/2016 | Zhai et al. | |
| 2017/0201011 | A1 * | 7/2017 | Khripkov | H01Q 1/42 |
| 2018/0017995 | A1 | 1/2018 | Gable et al. | |
| 2018/0026341 | A1 * | 1/2018 | Mow | H01Q 1/2291 343/702 |
| 2019/0013584 | A1 | 1/2019 | Ryu et al. | |
| 2019/0027802 | A1 * | 1/2019 | Noori | H01Q 19/005 |

* cited by examiner

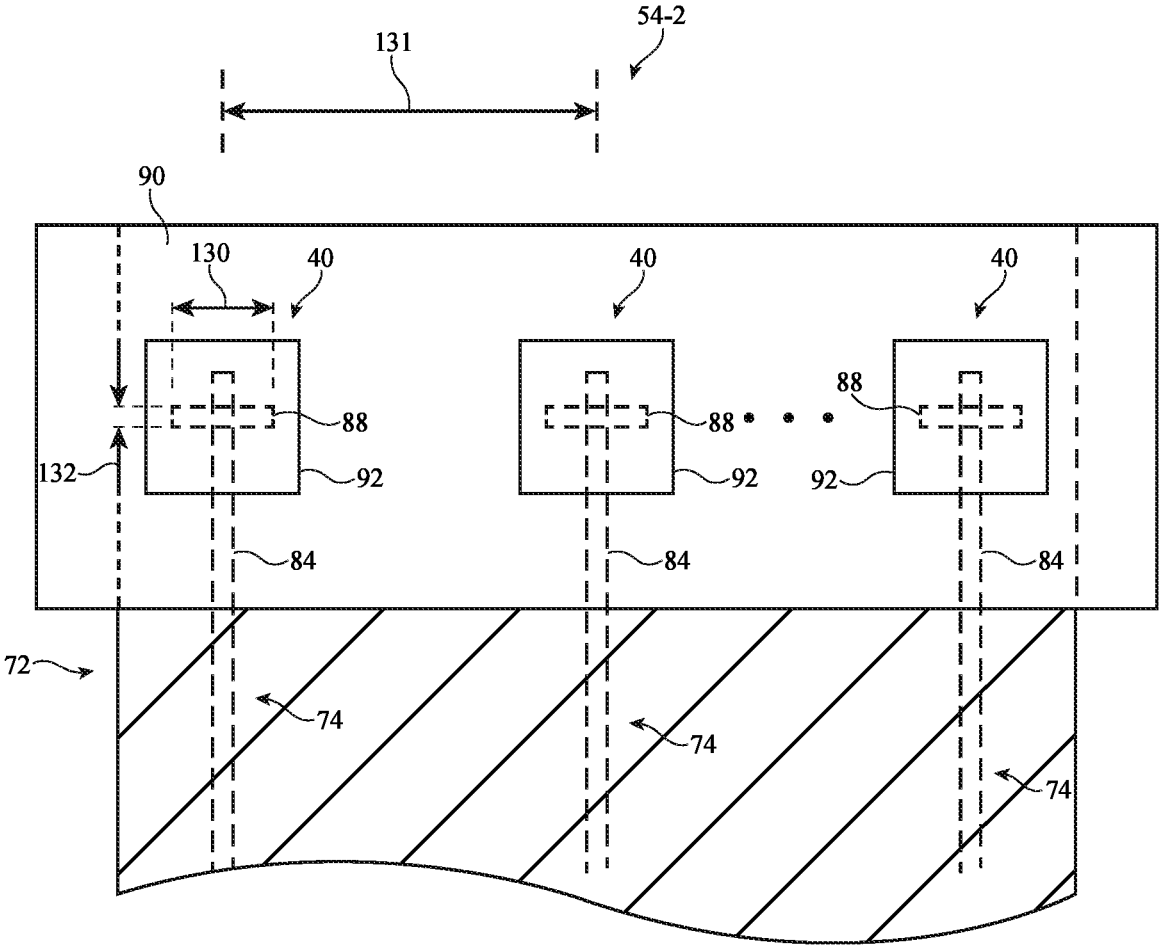
FIG. 10
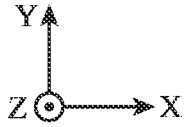

ELECTRONIC DEVICES WITH DIELECTRIC RESONATOR ANTENNAS

This application is a division of patent application Ser. No. 16/289,433, filed Feb. 28, 2019, which is hereby incorporated by reference herein in its entirety.

BACKGROUND

This relates generally to electronic devices and, more particularly, to electronic devices with wireless circuitry.

Electronic devices often include wireless circuitry. For example, cellular telephones, computers, and other devices often contain antennas and wireless transceivers for supporting wireless communications.

It may be desirable to support wireless communications in millimeter wave and centimeter wave communications bands. Millimeter wave communications, which are sometimes referred to as extremely high frequency (EHF) communications, and centimeter wave communications involve communications at frequencies of about 10-300 GHz. Operation at these frequencies may support high bandwidths but may raise significant challenges. For example, radio-frequency communications in millimeter and centimeter wave communications bands can be characterized by substantial attenuation and/or distortion during signal propagation through various mediums. In addition, the presence of conductive electronic device components can make it difficult to incorporate circuitry for handling millimeter and centimeter wave communications into the electronic device.

It would therefore be desirable to be able to provide electronic devices with improved wireless circuitry such as wireless circuitry that supports millimeter and centimeter wave communications.

SUMMARY

An electronic device may be provided with a housing, a display, and wireless circuitry. The housing may include peripheral conductive housing structures that run around a periphery of the device. The display may include a display cover layer mounted to the peripheral conductive housing structures. The wireless circuitry may include a phased antenna array that conveys radio-frequency signals in one or more frequency bands between 10 GHz and 300 GHz. The phased antenna array may convey the radio-frequency signals through the display cover layer or other dielectric cover layers in the device.

The phased antenna array may include dielectric resonator antennas. Each dielectric resonator antenna may include a dielectric resonating element formed from a column of relatively high dielectric constant material that is embedded within a surrounding dielectric substrate. The dielectric substrate may be formed from a relatively low dielectric constant material. The dielectric substrate and the dielectric resonating element may be mounted to a flexible printed circuit. A radio-frequency transmission line such as a stripline for the dielectric resonator antenna may be formed on the flexible printed circuit. The flexible printed circuit may include ground traces. A slot may be formed in the ground traces and may be aligned with the dielectric resonating element. The stripline may indirectly feed radio-frequency signals for the slot via near-field electromagnetic coupling. The slot may couple the radio-frequency signals into the dielectric resonating element to excite one or more electromagnetic resonant modes of the dielectric resonating element. When excited, the dielectric resonating element may serve as a waveguide that propagates wave fronts of the radio-frequency signals along its length and through the display cover layer. The dielectric resonating element may exhibit a relatively small lateral footprint. This may allow the dielectric resonating elements of the phased antenna array to be mounted within a relatively narrow space between a display module for the display and the peripheral conductive housing structures.

A dielectric matching layer may be interposed between the dielectric resonating element and the display cover layer. The dielectric matching layer may help to match the impedance of the dielectric resonating element to the impedance of the display cover layer. If desired, the slot may be configured to form a slot antenna resonating element that radiates additional radio-frequency signals through the dielectric resonating element in addition to exciting the resonant modes of the dielectric resonating element. In this scenario, the dielectric matching layer may be provided with a tapered shape that helps to match the impedance of the display cover layer to the impedance of the dielectric resonating element in both the frequency band covered by the dielectric resonating element and the frequency band covered by the slot antenna resonating element.

The phased antenna array may include first and second sets of dielectric resonator antennas. The first set may convey radio-frequency signals in a first frequency band with a first linear polarization. The second set may convey radio-frequency signals in the first frequency band with an orthogonal second linear polarization. If desired, the phased antenna array may include third and fourth sets of dielectric resonator antennas. The third set may convey radio-frequency signals in a second frequency band with the first linear polarization. The fourth set may convey radio-frequency signals in the second frequency band with the second linear polarization. Because dielectric resonator antennas occupy less lateral area than other types of antennas such as patch antennas or slot antennas, the dielectric resonator antennas from the first, second, third, and/or fourth sets may be arranged in an interleaved pattern across the phased antenna array.

BRIEF DESCRIPTION OF THE DRAWINGS

FIG. 10 is a top-down view of illustrative dielectric resonator antennas arranged in a phased antenna array in accordance with some embodiments.

DETAILED DESCRIPTION

Figure 1:
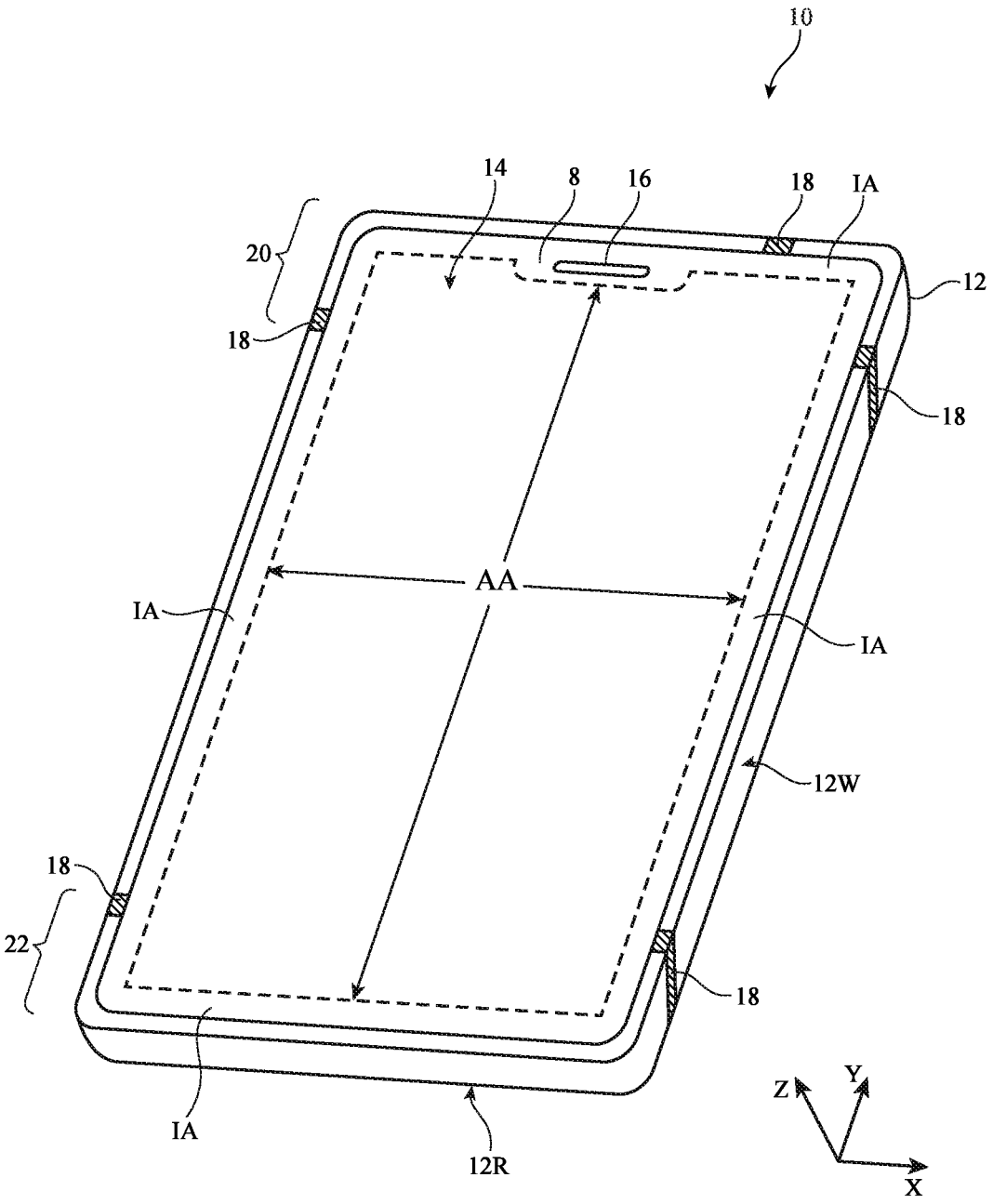
FIG. 1 is a perspective view of an illustrative electronic device in accordance with some embodiments.

An electronic device such as electronic device 10 of FIG. 1 may contain wireless circuitry. The wireless circuitry may include one or more antennas. The antennas may include phased antenna arrays that are used for performing wireless communications using millimeter and centimeter wave signals. Millimeter wave signals, which are sometimes referred to as extremely high frequency (EHF) signals, propagate at frequencies above about 30 GHz (e.g., at 60 GHz or other frequencies between about 30 GHz and 300 GHz). Centimeter wave signals propagate at frequencies between about 10 GHz and 30 GHz. If desired, device 10 may also contain antennas for handling satellite navigation system signals, cellular telephone signals, local wireless area network signals, near-field communications, light-based wireless communications, or other wireless communications.

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a handheld device such as a cellular telephone, a media player, or other small portable device. Device 10 may also be a set-top box, a desktop computer, a display into which a computer or other processing circuitry has been integrated, a display without an integrated computer, a wireless access point, a wireless base station, an electronic device incorporated into a kiosk, building, or vehicle, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material (e.g., glass, ceramic, plastic, sapphire, etc.). In other situations, housing 12 or at least some of the structures that make up housing 12 may be formed from metal elements.

Device 10 may, if desired, have a display such as display 14. Display 14 may be mounted on the front face of device 10. Display 14 may be a touch screen that incorporates capacitive touch electrodes or may be insensitive to touch. The rear face of housing 12 (i.e., the face of device 10 opposing the front face of device 10) may have a substantially planar housing wall such as rear housing wall 12R (e.g., a planar housing wall). Rear housing wall 12R may have slots that pass entirely through the rear housing wall and that therefore separate portions of housing 12 from each other. Rear housing wall 12R may include conductive portions and/or dielectric portions. If desired, rear housing wall 12R may include a planar metal layer covered by a thin layer or coating of dielectric such as glass, plastic, sapphire, or ceramic. Housing 12 may also have shallow grooves that do not pass entirely through housing 12. The slots and grooves may be filled with plastic or other dielectric. If desired, portions of housing 12 that have been separated from each other (e.g., by a through slot) may be joined by internal conductive structures (e.g., sheet metal or other metal members that bridge the slot).

Housing 12 may include peripheral housing structures such as peripheral structures 12W. Conductive portions of peripheral structures 12W and conductive portions of rear housing wall 12R may sometimes be referred to herein collectively as conductive structures of housing 12. Peripheral structures 12W may run around the periphery of device 10 and display 14. In configurations in which device 10 and display 14 have a rectangular shape with four edges, peripheral structures 12W may be implemented using peripheral housing structures that have a rectangular ring shape with four corresponding edges and that extend from rear housing wall 12R to the front face of device 10 (as an example). Peripheral structures 12W or part of peripheral structures 12W may serve as a bezel for display 14 (e.g., a cosmetic trim that surrounds all four sides of display 14 and/or that helps hold display 14 to device 10) if desired. Peripheral structures 12W may, if desired, form sidewall structures for device 10 (e.g., by forming a metal band with vertical sidewalls, curved sidewalls, etc.).

Peripheral structures 12W may be formed of a conductive material such as metal and may therefore sometimes be referred to as peripheral conductive housing structures, conductive housing structures, peripheral metal structures, peripheral conductive sidewalls, peripheral conductive sidewall structures, conductive housing sidewalls, peripheral conductive housing sidewalls, sidewalls, sidewall structures, or a peripheral conductive housing member (as examples). Peripheral conductive housing structures 12W may be formed from a metal such as stainless steel, aluminum, or other suitable materials. One, two, or more than two separate structures may be used in forming peripheral conductive housing structures 12W.

It is not necessary for peripheral conductive housing structures 12W to have a uniform cross-section. For example, the top portion of peripheral conductive housing structures 12W may, if desired, have an inwardly protruding ledge that helps hold display 14 in place. The bottom portion of peripheral conductive housing structures 12W may also have an enlarged lip (e.g., in the plane of the rear surface of device 10). Peripheral conductive housing structures 12W may have substantially straight vertical sidewalls, may have sidewalls that are curved, or may have other suitable shapes. In some configurations (e.g., when peripheral conductive housing structures 12W serve as a bezel for display 14), peripheral conductive housing structures 12W may run around the lip of housing 12 (i.e., peripheral conductive housing structures 12W may cover only the edge of housing 12 that surrounds display 14 and not the rest of the sidewalls of housing 12).

Rear housing wall 12R may lie in a plane that is parallel to display 14. In configurations for device 10 in which some or all of rear housing wall 12R is formed from metal, it may be desirable to form parts of peripheral conductive housing structures 12W as integral portions of the housing structures forming rear housing wall 12R. For example, rear housing wall 12R of device 10 may include a planar metal structure and portions of peripheral conductive housing structures 12W on the sides of housing 12 may be formed as flat or curved vertically extending integral metal portions of the planar metal structure (e.g., housing structures 12R and 12W may be formed from a continuous piece of metal in a unibody configuration). Housing structures such as these may, if desired, be machined from a block of metal and/or may include multiple metal pieces that are assembled together to form housing 12. Rear housing wall 12R may have one or more, two or more, or three or more portions. Peripheral conductive housing structures 12W and/or conductive portions of rear housing wall 12R may form one or more exterior surfaces of device 10 (e.g., surfaces that are visible to a user of device 10) and/or may be implemented using internal structures that do not form exterior surfaces of device 10 (e.g., conductive housing structures that are not visible to a user of device 10 such as conductive structures that are covered with layers such as thin cosmetic layers, protective coatings, and/or other coating layers that may include dielectric materials such as glass, ceramic, plastic, or other structures that form the exterior surfaces of device 10 and/or serve to hide peripheral conductive housing structures 12W and/or conductive portions of rear housing wall 12R from view of the user).

Display 14 may have an array of pixels that form an active area AA that displays images for a user of device 10. For example, active area AA may include an array of display pixels. The array of pixels may be formed from liquid crystal display (LCD) components, an array of electrophoretic pixels, an array of plasma display pixels, an array of organic light-emitting diode display pixels or other light-emitting diode pixels, an array of electrowetting display pixels, or display pixels based on other display technologies. If desired, active area AA may include touch sensors such as touch sensor capacitive electrodes, force sensors, or other sensors for gathering a user input.

Display 14 may have an inactive border region that runs along one or more of the edges of active area AA. Inactive area IA of display 14 may be free of pixels for displaying images and may overlap circuitry and other internal device structures in housing 12. To block these structures from view by a user of device 10, the underside of the display cover layer or other layers in display 14 that overlap inactive area IA may be coated with an opaque masking layer in inactive area IA. The opaque masking layer may have any suitable color. Inactive area IA may include a recessed region such as notch 8 that extends into active area AA. Active area AA may, for example, be defined by the lateral area of a display module for display 14 (e.g., a display module that includes pixel circuitry, touch sensor circuitry, etc.). The display module may have a recess or notch in upper region 20 of device 10 that is free from active display circuitry (i.e., that forms notch 8 of inactive area IA). Notch 8 may be a substantially rectangular region that is surrounded (defined) on three sides by active area AA and on a fourth side by peripheral conductive housing structures 12W.

Display 14 may be protected using a display cover layer such as a layer of transparent glass, clear plastic, transparent ceramic, sapphire, or other transparent crystalline material, or other transparent layer(s). The display cover layer may have a planar shape, a convex curved profile, a shape with planar and curved portions, a layout that includes a planar main area surrounded on one or more edges with a portion that is bent out of the plane of the planar main area, or other suitable shapes. The display cover layer may cover the entire front face of device 10. In another suitable arrangement, the display cover layer may cover substantially all of the front face of device 10 or only a portion of the front face of device 10. Openings may be formed in the display cover layer. For example, an opening may be formed in the display cover layer to accommodate a button. An opening may also be formed in the display cover layer to accommodate ports such as speaker port 16 in notch 8 or a microphone port. Openings may be formed in housing 12 to form communications ports (e.g., an audio jack port, a digital data port, etc.) and/or audio ports for audio components such as a speaker and/or a microphone if desired.

Display 14 may include conductive structures such as an array of capacitive electrodes for a touch sensor, conductive lines for addressing pixels, driver circuits, etc. Housing 12 may include internal conductive structures such as metal frame members and a planar conductive housing member (sometimes referred to as a backplate) that spans the walls of housing 12 (i.e., a substantially rectangular sheet formed from one or more metal parts that is welded or otherwise connected between opposing sides of peripheral conductive structures 12W). The backplate may form an exterior rear surface of device 10 or may be covered by layers such as thin cosmetic layers, protective coatings, and/or other coatings that may include dielectric materials such as glass, ceramic, plastic, or other structures that form the exterior surfaces of device 10 and/or serve to hide the backplate from view of the user. Device 10 may also include conductive structures such as printed circuit boards, components mounted on printed circuit boards, and other internal conductive structures. These conductive structures, which may be used in forming a ground plane in device 10, may extend under active area AA of display 14, for example.

In regions 22 and 20, openings may be formed within the conductive structures of device 10 (e.g., between peripheral conductive housing structures 12W and opposing conductive ground structures such as conductive portions of rear housing wall 12R, conductive traces on a printed circuit board, conductive electrical components in display 14, etc.). These openings, which may sometimes be referred to as gaps, may be filled with air, plastic, and/or other dielectrics and may be used in forming slot antenna resonating elements for one or more antennas in device 10, if desired.

Conductive housing structures and other conductive structures in device 10 may serve as a ground plane for the antennas in device 10. The openings in regions 22 and 20 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 22 and 20. If desired, the ground plane that is under active area AA of display 14 and/or other metal structures in device 10 may have portions that extend into parts of the ends of device 10 (e.g., the ground may extend towards the dielectric-filled openings in regions 22 and 20), thereby narrowing the slots in regions 22 and 20.

In general, device 10 may include any suitable number of antennas (e.g., one or more, two or more, three or more, four or more, etc.). The antennas in device 10 may be located at opposing first and second ends of an elongated device housing (e.g., ends at regions 22 and 20 of device 10 of FIG. 1), along one or more edges of a device housing, in the center of a device housing, in other suitable locations, or in one or more of these locations. The arrangement of FIG. 1 is merely illustrative.

Portions of peripheral conductive housing structures 12W may be provided with peripheral gap structures. For example, peripheral conductive housing structures 12W may be provided with one or more gaps such as gaps 18, as shown in FIG. 1. The gaps in peripheral conductive housing structures 12W may be filled with dielectric such as polymer, ceramic, glass, air, other dielectric materials, or combinations of these materials. Gaps 18 may divide peripheral conductive housing structures 12W into one or more peripheral conductive segments. The conductive segments that are formed in this way may form parts of antennas in device 10 if desired. Other dielectric openings may be formed in peripheral conductive housing structures 12W (e.g., dielectric openings other than gaps 18) and may serve as dielectric antenna windows for antennas mounted within the interior of device 10. Antennas within device 10 may be aligned with the dielectric antenna windows for conveying radio-frequency signals through peripheral conductive housing structures 12W. Antennas within device 10 may also be aligned with inactive area IA of display 14 for conveying radio-frequency signals through display 14.

In order to provide an end user of device 10 with as large of a display as possible (e.g., to maximize an area of the device used for displaying media, running applications, etc.), it may be desirable to increase the amount of area at the front face of device 10 that is covered by active area AA of display 14. Increasing the size of active area AA may reduce the size of inactive area IA within device 10. This may reduce the area behind display 14 that is available for antennas within device 10. For example, active area AA of display 14 may include conductive structures that serve to block radio-frequency signals handled by antennas mounted behind active area AA from radiating through the front face of device 10. It would therefore be desirable to be able to provide antennas that occupy a small amount of space within device 10 (e.g., to allow for as large of a display active area AA as possible) while still allowing the antennas to communicate with wireless equipment external to device 10 with satisfactory efficiency bandwidth.

In a typical scenario, device 10 may have one or more upper antennas and one or more lower antennas (as an example). An upper antenna may, for example, be formed at the upper end of device 10 in region 20. A lower antenna may, for example, be formed at the lower end of device 10 in region 22. Additional antennas may be formed along the edges of housing 12 extending between regions 20 and 22 if desired. The antennas may be used separately to cover identical communications bands, overlapping communications bands, or separate communications bands. The antennas may be used to implement an antenna diversity scheme or a multiple-input-multiple-output (MIMO) antenna scheme. Other antennas for covering any other desired frequencies may also be mounted at any desired locations within the interior of device 10. The example of FIG. 1 is merely illustrative. If desired, housing 12 may have other shapes (e.g., a square shape, cylindrical shape, spherical shape, combinations of these and/or different shapes, etc.).

Figure 2:
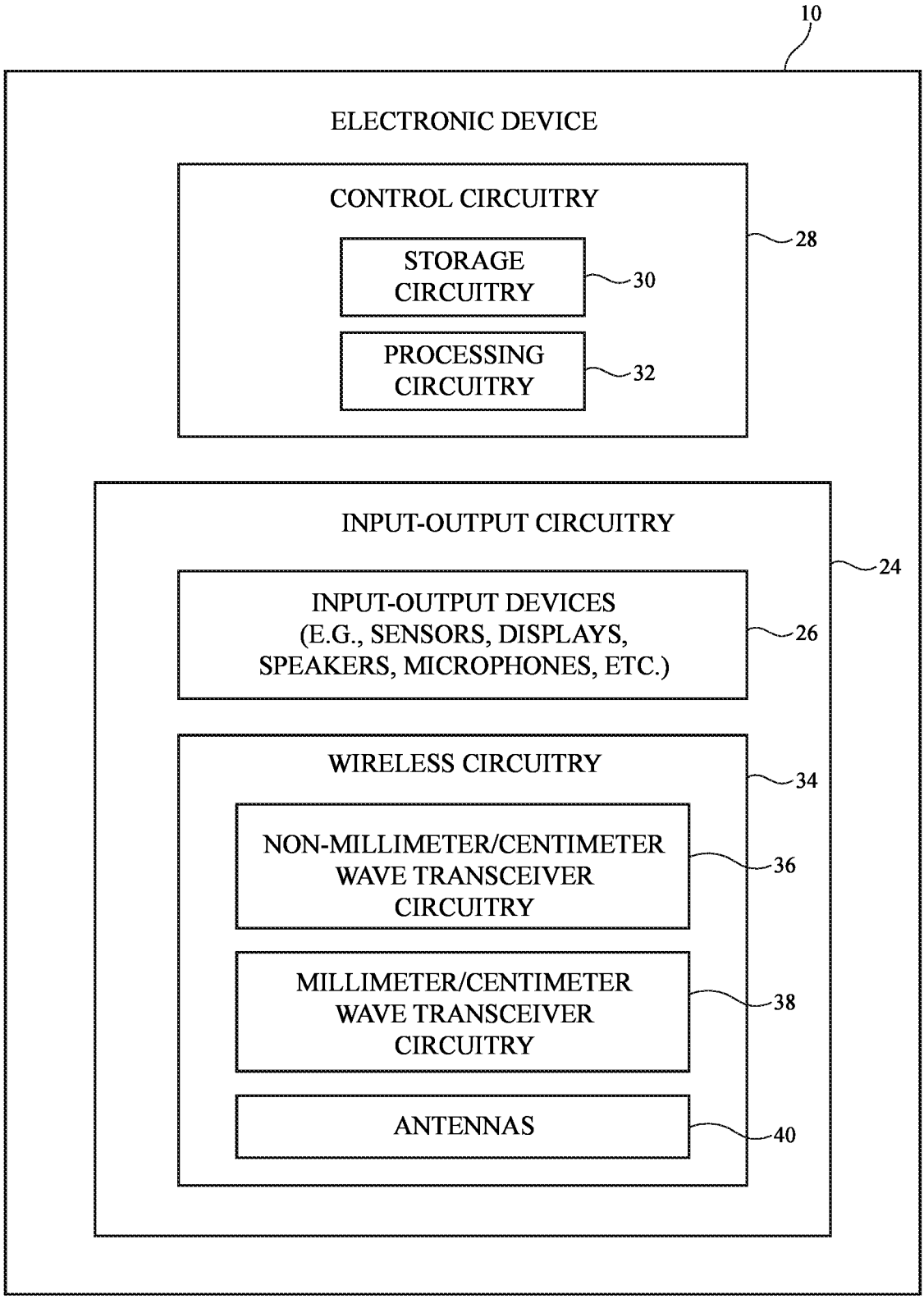
FIG. 2 is a schematic diagram of illustrative circuitry in an electronic device in accordance with some embodiments.

A schematic diagram of illustrative components that may be used in device 10 is shown in FIG. 2. As shown in FIG. 2, device 10 may include control circuitry 28. Control circuitry 28 may include storage such as storage circuitry 30. Storage circuitry 30 may include hard disk drive storage, nonvolatile memory (e.g., flash memory or other electrically-programmable-read-only memory configured to form a solid-state drive), volatile memory (e.g., static or dynamic random-access-memory), etc. Control circuitry 28 may include processing circuitry such as processing circuitry 32. Processing circuitry 32 may be used to control the operation of device 10. Processing circuitry 32 may include on one or more microprocessors, microcontrollers, digital signal processors, host processors, baseband processor integrated circuits, application specific integrated circuits, central processing units (CPUs), etc. Control circuitry 28 may be configured to perform operations in device 10 using hardware (e.g., dedicated hardware or circuitry), firmware, and/or software. Software code for performing operations in device 10 may be stored on storage circuitry 30 (e.g., storage circuitry 30 may include non-transitory (tangible) computer readable storage media that stores the software code). The software code may sometimes be referred to as program instructions, software, data, instructions, or code. Software code stored on storage circuitry 30 may be executed by processing circuitry 32.

Control circuitry 28 may be used to run software on device 10 such as internet browsing applications, voice-over-internet-protocol (VOIP) telephone call applications, email applications, media playback applications, operating system functions, etc. To support interactions with external equipment, control circuitry 28 may be used in implementing communications protocols. Communications protocols that may be implemented using control circuitry 28 include internet protocols, wireless local area network protocols (e.g., IEEE 802.11 protocols—sometimes referred to as WiFi®), protocols for other short-range wireless communications links such as the Bluetooth® protocol or other WPAN protocols, IEEE 802.11ad protocols, cellular telephone protocols, MIMO protocols, antenna diversity protocols, satellite navigation system protocols, antenna-based spatial ranging protocols (e.g., radio detection and ranging (RADAR) protocols or other desired range detection protocols for signals conveyed at millimeter and centimeter wave frequencies), etc. Each communication protocol may be associated with a corresponding radio access technology (RAT) that specifies the physical connection methodology used in implementing the protocol.

Device 10 may include input-output circuitry 24. Input-output circuitry 24 may include input-output devices 26. Input-output devices 26 may be used to allow data to be supplied to device 10 and to allow data to be provided from device 10 to external devices. Input-output devices 26 may include user interface devices, data port devices, sensors, and other input-output components. For example, input-output devices may include touch screens, displays without touch sensor capabilities, buttons, joysticks, scrolling wheels, touch pads, key pads, keyboards, microphones, cameras, speakers, status indicators, light sources, audio jacks and other audio port components, digital data port devices, light sensors, gyroscopes, accelerometers or other components that can detect motion and device orientation relative to the Earth, capacitance sensors, proximity sensors (e.g., a capacitive proximity sensor and/or an infrared proximity sensor), magnetic sensors, and other sensors and input-output components.

Input-output circuitry 24 may include wireless circuitry such as wireless circuitry 34 for wirelessly conveying radio-frequency signals. While control circuitry 28 is shown separately from wireless circuitry 34 in the example of FIG. 2 for the sake of clarity, wireless circuitry 34 may include processing circuitry that forms a part of processing circuitry 32 and/or storage circuitry that forms a part of storage circuitry 30 of control circuitry 28 (e.g., portions of control circuitry 28 may be implemented on wireless circuitry 34). As an example, control circuitry 28 may include baseband processor circuitry or other control components that form a part of wireless circuitry 34.

Wireless circuitry 34 may include millimeter and centimeter wave transceiver circuitry such as millimeter/centimeter wave transceiver circuitry 38. Millimeter/centimeter wave transceiver circuitry 38 may support communications at frequencies between about 10 GHz and 300 GHz. For example, millimeter/centimeter wave transceiver circuitry 38 may support communications in Extremely High Frequency (EHF) or millimeter wave communications bands between about 30 GHz and 300 GHz and/or in centimeter wave communications bands between about 10 GHz and 30 GHz (sometimes referred to as Super High Frequency (SHF) bands). As examples, millimeter/centimeter wave transceiver circuitry 38 may support communications in an IEEE K communications band between about 18 GHz and 27 GHz, a $K_a$ communications band between about 26.5 GHz and 40 GHz, a $K_u$ communications band between about 12 GHz and 18 GHz, a V communications band between about 40 GHz and 75 GHz, a W communications band between about 75 GHz and 110 GHz, or any other desired frequency band between approximately 10 GHz and 300 GHz. If desired, millimeter/centimeter wave transceiver circuitry 38 may support IEEE 802.11ad communications at 60 GHz and/or $5^{th}$ generation mobile networks or $5^{th}$ generation wireless systems (5G) communications bands between 27 GHz and 90 GHz. Millimeter/centimeter wave transceiver circuitry 38 may be formed from one or more integrated circuits (e.g., multiple integrated circuits mounted on a common printed circuit in a system-in-package device, one or more integrated circuits mounted on different substrates, etc.).

If desired, millimeter/centimeter wave transceiver circuitry 38 (sometimes referred to herein simply as transceiver circuitry 38 or millimeter/centimeter wave circuitry 38) may perform spatial ranging operations using radio-frequency signals at millimeter and/or centimeter wave signals that are transmitted and received by millimeter/centimeter wave transceiver circuitry 38. The received signals may be a version of the transmitted signals that have been reflected off of external objects and back towards device 10. Control circuitry 28 may process the transmitted and received signals to detect or estimate a range between device 10 and one or more external objects in the surroundings of device 10 (e.g., objects external to device 10 such as the body of a user or other persons, other devices, animals, furniture, walls, or other objects or obstacles in the vicinity of device 10). If desired, control circuitry 28 may also process the transmitted and received signals to identify a two or three-dimensional spatial location of the external objects relative to device 10.

Spatial ranging operations performed by millimeter/centimeter wave transceiver circuitry 38 are unidirectional. Millimeter/centimeter wave transceiver circuitry 38 may perform bidirectional communications with external wireless equipment. Bidirectional communications involve both the transmission of wireless data by millimeter/centimeter wave transceiver circuitry 38 and the reception of wireless data that has been transmitted by external wireless equipment. The wireless data may, for example, include data that has been encoded into corresponding data packets such as wireless data associated with a telephone call, streaming media content, internet browsing, wireless data associated with software applications running on device 10, email messages, etc.

If desired, wireless circuitry 34 may include transceiver circuitry for handling communications at frequencies below 10 GHz such as non-millimeter/centimeter wave transceiver circuitry 36. Non-millimeter/centimeter wave transceiver circuitry 36 may include wireless local area network (WLAN) transceiver circuitry that handles 2.4 GHz and 5 GHz bands for Wi-Fi® (IEEE 802.11) communications, wireless personal area network (WPAN) transceiver circuitry that handles the 2.4 GHz Bluetooth® communications band, cellular telephone transceiver circuitry that handles cellular telephone communications bands from 700 to 960 MHz, 1710 to 2170 MHz, 2300 to 2700 MHz, and/or or any other desired cellular telephone communications bands between 600 MHz and 4000 MHz, GPS receiver circuitry that receives GPS signals at 1575 MHz or signals for handling other satellite positioning data (e.g., GLONASS signals at 1609 MHz), television receiver circuitry, AM/FM radio receiver circuitry, paging system transceiver circuitry, near field communications (NFC) circuitry, etc. Non-millimeter/centimeter wave transceiver circuitry 36 and millimeter/centimeter wave transceiver circuitry 38 may each include one or more integrated circuits, power amplifier circuitry, low-noise input amplifiers, passive radio-frequency components, switching circuitry, transmission line structures, and other circuitry for handling radio-frequency signals.

Wireless circuitry 34 may include antennas 40. Non-millimeter/centimeter wave transceiver circuitry 36 may transmit and receive radio-frequency signals below 10 GHz using one or more antennas 40. Millimeter/centimeter wave transceiver circuitry 38 may transmit and receive radio-frequency signals above 10 GHz (e.g., at millimeter wave and/or centimeter wave frequencies) using antennas 40.

In satellite navigation system links, cellular telephone links, and other long-range links, radio-frequency signals are typically used to convey data over thousands of feet or miles. In Wi-Fi® and Bluetooth® links at 2.4 and 5 GHz and other short-range wireless links, radio-frequency signals are typically used to convey data over tens or hundreds of feet. Millimeter/centimeter wave transceiver circuitry 38 may convey radio-frequency signals over short distances that travel over a line-of-sight path. To enhance signal reception for millimeter and centimeter wave communications, phased antenna arrays and beam steering techniques may be used (e.g., schemes in which antenna signal phase and/or magnitude for each antenna in an array are adjusted to perform beam steering). Antenna diversity schemes may also be used to ensure that the antennas that have become blocked or that are otherwise degraded due to the operating environment of device 10 can be switched out of use and higher-performing antennas used in their place.

Antennas 40 in wireless circuitry 34 may be formed using any suitable antenna types. For example, antennas 40 may include antennas with resonating elements that are formed from stacked patch antenna structures, loop antenna structures, patch antenna structures, inverted-F antenna structures, slot antenna structures, planar inverted-F antenna structures, monopole antenna structures, dipole antenna structures, helical antenna structures, Yagi (Yagi-Uda) antenna structures, hybrids of these designs, etc. In another suitable arrangement, antennas 40 may include antennas with dielectric resonating elements such as dielectric resonator antennas. If desired, one or more of antennas 40 may be cavity-backed antennas. Different types of antennas may be used for different bands and combinations of bands. For example, one type of antenna may be used in forming a non-millimeter/centimeter wave wireless link for non-millimeter/centimeter wave transceiver circuitry 36 and another type of antenna may be used in conveying radio-frequency signals at millimeter and/or centimeter wave frequencies for millimeter/centimeter wave transceiver circuitry 38. Antennas 40 that are used to convey radio-frequency signals at millimeter and centimeter wave frequencies may be arranged in one or more phased antenna arrays.

Figure 3:
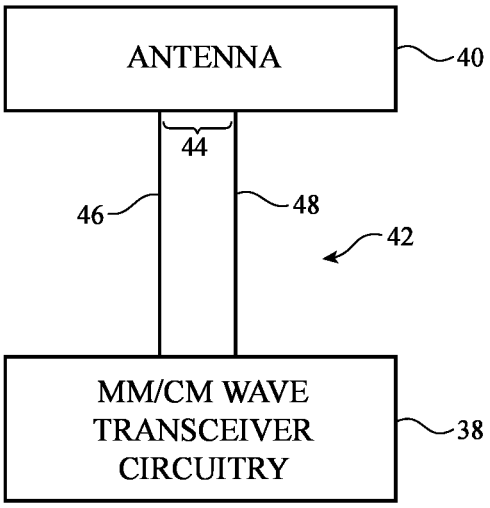
FIG. 3 is a schematic diagram of illustrative wireless circuitry in accordance with some embodiments.

A schematic diagram of an antenna 40 that may be formed in a phased antenna array for conveying radio-frequency signals at millimeter and centimeter wave frequencies is shown in FIG. 3. As shown in FIG. 3, antenna 40 may be coupled to millimeter/centimeter (MM/CM) wave transceiver circuitry 38. Millimeter/centimeter wave transceiver circuitry 38 may be coupled to antenna feed 44 of antenna 40 using a transmission line path that includes radio-frequency transmission line 42. Radio-frequency transmission line 42 may include a positive signal conductor such as signal conductor 46 and may include a ground conductor such as ground conductor 48. Ground conductor 48 may be coupled to the antenna ground for antenna 40 (e.g., over a ground antenna feed terminal of antenna feed 44 located on the antenna ground). Signal conductor 46 may be coupled to the antenna resonating element for antenna 40. For example, signal conductor 46 may be coupled to a positive antenna feed terminal of antenna feed 44 located on the antenna resonating element. In another suitable arrangement, antenna 40 may be indirectly fed. For example, signal conductor 46 may indirectly feed radio-frequency signals to a portion of antenna 40 via near-field electromagnetic coupling and the antenna resonating element for antenna 40 may radiate the indirectly-fed radio-frequency signals.

Radio-frequency transmission line 42 may include a stripline transmission line (sometimes referred to herein simply as a stripline), a coaxial cable, a coaxial probe realized by metalized vias, a microstrip transmission line, an edge-coupled microstrip transmission line, an edge-coupled stripline transmission lines, a waveguide structure, combinations of these, etc. Multiple types of transmission lines may be used to form the transmission line path that couples millimeter/centimeter wave transceiver circuitry 38 to antenna feed 44. Filter circuitry, switching circuitry, impedance matching circuitry, phase shifter circuitry, amplifier circuitry, and/or other circuitry may be interposed on radio-frequency transmission line 42, if desired.

Radio-frequency transmission lines in device 10 may be integrated into ceramic substrates, rigid printed circuit boards, and/or flexible printed circuits. In one suitable arrangement, radio-frequency transmission lines in device 10 may be integrated within multilayer laminated structures (e.g., layers of a conductive material such as copper and a dielectric material such as a resin that are laminated together without intervening adhesive) that may be folded or bent in multiple dimensions (e.g., two or three dimensions) and that maintain a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures may be batch laminated together (e.g., in a single pressing process) without adhesive (e.g., as opposed to performing multiple pressing processes to laminate multiple layers together with adhesive).

Figure 4:
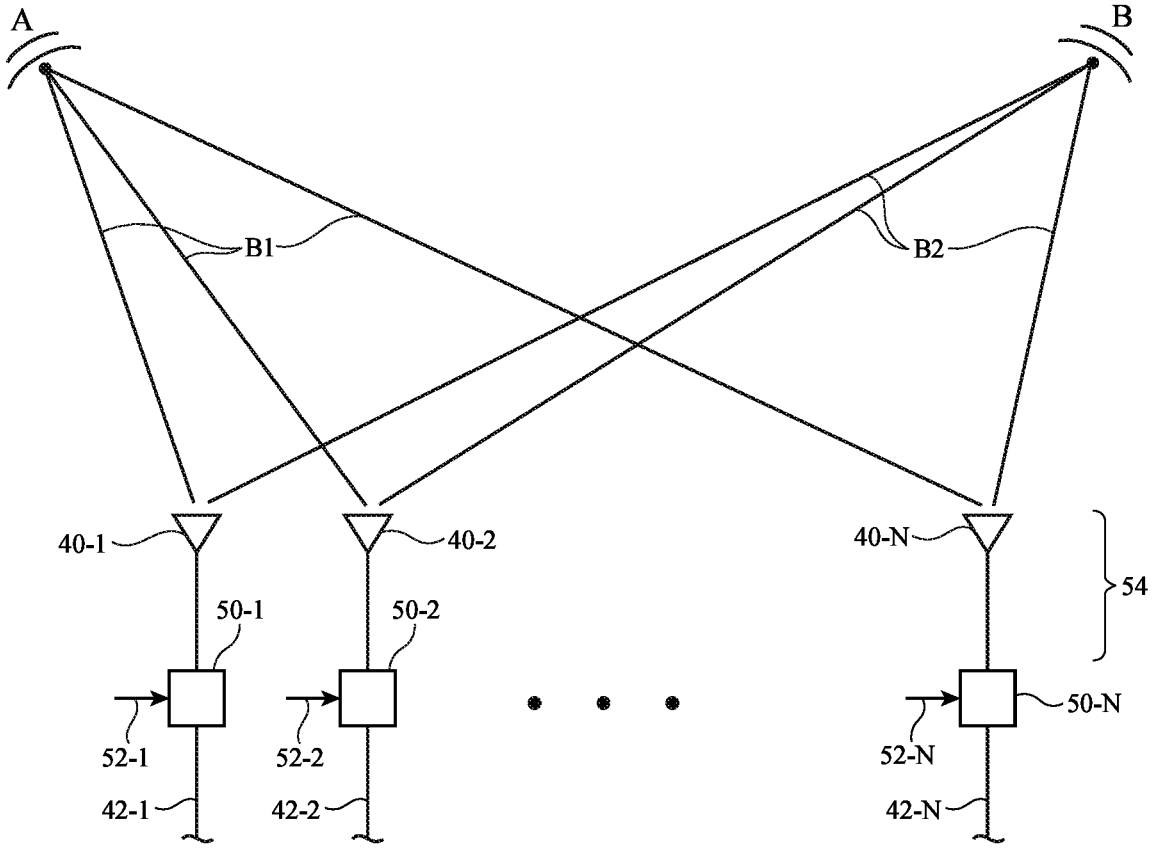
FIG. 4 is a diagram of an illustrative phased antenna array that may be adjusted using control circuitry to direct a beam of signals in accordance with some embodiments.

FIG. 4 shows how antennas 40 for handling radio-frequency signals at millimeter and centimeter wave frequencies may be formed in a phased antenna array. As shown in FIG. 4, phased antenna array 54 (sometimes referred to herein as array 54, antenna array 54, or array 54 of antennas 40) may be coupled to radio-frequency transmission lines 42. For example, a first antenna 40-1 in phased antenna array 54 may be coupled to a first radio-frequency transmission line 42-1, a second antenna 40-2 in phased antenna array 54 may be coupled to a second radio-frequency transmission line 42-2, an Nth antenna 40-N in phased antenna array 54 may be coupled to an Nth radio-frequency transmission line 42-N, etc. While antennas 40 are described herein as forming a phased antenna array, the antennas 40 in phased antenna array 54 may sometimes also be referred to as collectively forming a single phased array antenna.

Antennas 40 in phased antenna array 54 may be arranged in any desired number of rows and columns or in any other desired pattern (e.g., the antennas need not be arranged in a grid pattern having rows and columns). During signal transmission operations, radio-frequency transmission lines 42 may be used to supply signals (e.g., radio-frequency signals such as millimeter wave and/or centimeter wave signals) from millimeter/centimeter wave transceiver circuitry 38 (FIG. 3) to phased antenna array 54 for wireless transmission. During signal reception operations, radio-frequency transmission lines 42 may be used to convey signals received at phased antenna array 54 (e.g., from external wireless equipment or transmitted signals that have been reflected off of external objects) to millimeter/centimeter wave transceiver circuitry 38 (FIG. 3).

The use of multiple antennas 40 in phased antenna array 54 allows beam steering arrangements to be implemented by controlling the relative phases and magnitudes (amplitudes) of the radio-frequency signals conveyed by the antennas. In the example of FIG. 4, antennas 40 each have a corresponding radio-frequency phase and magnitude controller 50 (e.g., a first phase and magnitude controller 50-1 interposed on radio-frequency transmission line 42-1 may control phase and magnitude for radio-frequency signals handled by antenna 40-1, a second phase and magnitude controller 50-2 interposed on radio-frequency transmission line 42-2 may control phase and magnitude for radio-frequency signals handled by antenna 40-2, an Nth phase and magnitude controller 50-N interposed on radio-frequency transmission line 42-N may control phase and magnitude for radio-frequency signals handled by antenna 40-N, etc.).

Phase and magnitude controllers 50 may each include circuitry for adjusting the phase of the radio-frequency signals on radio-frequency transmission lines 42 (e.g., phase shifter circuits) and/or circuitry for adjusting the magnitude of the radio-frequency signals on radio-frequency transmission lines 42 (e.g., power amplifier and/or low noise amplifier circuits). Phase and magnitude controllers 50 may sometimes be referred to collectively herein as beam steering circuitry (e.g., beam steering circuitry that steers the beam of radio-frequency signals transmitted and/or received by phased antenna array 54).

Phase and magnitude controllers 50 may adjust the relative phases and/or magnitudes of the transmitted signals that are provided to each of the antennas in phased antenna array 54 and may adjust the relative phases and/or magnitudes of the received signals that are received by phased antenna array 54. Phase and magnitude controllers 50 may, if desired, include phase detection circuitry for detecting the phases of the received signals that are received by phased antenna array 54. The term "beam" or "signal beam" may be used herein to collectively refer to wireless signals that are transmitted and received by phased antenna array 54 in a particular direction. The signal beam may exhibit a peak gain that is oriented in a particular pointing direction at a corresponding pointing angle (e.g., based on constructive and destructive interference from the combination of signals from each antenna in the phased antenna array). The term "transmit beam" may sometimes be used herein to refer to radio-frequency signals that are transmitted in a particular direction whereas the term "receive beam" may sometimes be used herein to refer to radio-frequency signals that are received from a particular direction.

If, for example, phase and magnitude controllers 50 are adjusted to produce a first set of phases and/or magnitudes for transmitted radio-frequency signals, the transmitted signals will form a transmit beam as shown by beam B1 of FIG. 4 that is oriented in the direction of point A. If, however, phase and magnitude controllers 50 are adjusted to produce a second set of phases and/or magnitudes for the transmitted signals, the transmitted signals will form a transmit beam as shown by beam B2 that is oriented in the direction of point B. Similarly, if phase and magnitude controllers 50 are adjusted to produce the first set of phases and/or magnitudes, radio-frequency signals (e.g., radio-frequency signals in a receive beam) may be received from the direction of point A, as shown by beam B1. If phase and magnitude controllers 50 are adjusted to produce the second set of phases and/or magnitudes, radio-frequency signals may be received from the direction of point B, as shown by beam B2.

Each phase and magnitude controller 50 may be controlled to produce a desired phase and/or magnitude based on a corresponding control signal 52 received from control circuitry 28 of FIG. 2 (e.g., the phase and/or magnitude provided by phase and magnitude controller 50-1 may be controlled using control signal 52-1, the phase and/or magnitude provided by phase and magnitude controller 50-2 may be controlled using control signal 52-2, etc.). If desired, the control circuitry may actively adjust control signals 52 in real time to steer the transmit or receive beam in different desired directions over time. Phase and magnitude controllers 50 may provide information identifying the phase of received signals to control circuitry 28 if desired.

When performing wireless communications using radio-frequency signals at millimeter and centimeter wave frequencies, the radio-frequency signals are conveyed over a line of sight path between phased antenna array 54 and external communications equipment. If the external object is located at point A of FIG. 4, phase and magnitude controllers 50 may be adjusted to steer the signal beam towards point A (e.g., to steer the pointing direction of the signal beam towards point A). Phased antenna array 54 may transmit and receive radio-frequency signals in the direction of point A. Similarly, if the external communications equipment is located at point B, phase and magnitude controllers 50 may be adjusted to steer the signal beam towards point B (e.g., to steer the pointing direction of the signal beam towards point B). Phased antenna array 54 may transmit and receive radio-frequency signals in the direction of point B. In the example of FIG. 4, beam steering is shown as being performed over a single degree of freedom for the sake of simplicity (e.g., towards the left and right on the page of FIG. 4). However, in practice, the beam may be steered over two or more degrees of freedom (e.g., in three dimensions, into and out of the page and to the left and right on the page of FIG. 4). Phased antenna array 54 may have a corresponding field of view over which beam steering can be performed (e.g., in a hemisphere or a segment of a hemisphere over the phased antenna array). If desired, device 10 may include multiple phased antenna arrays that each face a different direction to provide coverage from multiple sides of the device.

Figure 5:
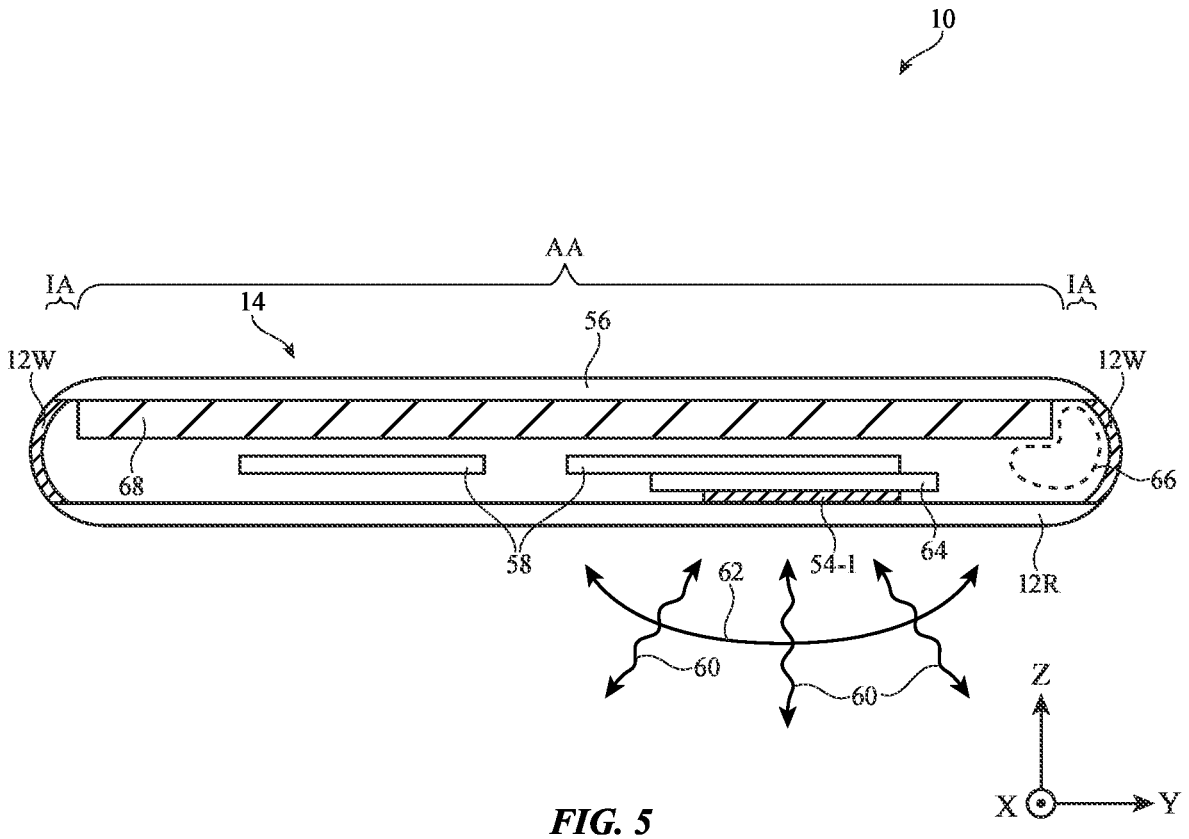
FIG. 5 is a cross-sectional side view of an illustrative electronic device having phased antenna arrays for radiating through different sides of the device in accordance with some embodiments.

FIG. 5 is a cross-sectional side view of device 10 in an example where device 10 has multiple phased antenna arrays. As shown in FIG. 5, peripheral conductive housing structures 12W may extend around the (lateral) periphery of device 10 and may extend from rear housing wall 12R to display 14. Display 14 may have a display module such as display module 68 (sometimes referred to as a display panel). Display module 68 may include pixel circuitry, touch sensor circuitry, force sensor circuitry, and/or any other desired circuitry for forming active area AA of display 14. Display 14 may include a dielectric cover layer such as display cover layer 56 that overlaps display module 68. Display module 68 may emit image light and may receive sensor input through display cover layer 56. Display cover layer 56 and display 14 may be mounted to peripheral conductive housing structures 12W. The lateral area of display 14 that does not overlap display module 68 may form inactive area IA of display 14.

Device 10 may include multiple phased antenna arrays 54 such as a rear-facing phased antenna array 54-1. As shown in FIG. 5, phased antenna array 54-1 may transmit and receive radio-frequency signals 60 at millimeter and centimeter wave frequencies through rear housing wall 12R. In scenarios where rear housing wall 12R includes metal portions, radio-frequency signals 60 may be conveyed through an aperture or opening in the metal portions of rear housing wall 12R or may be conveyed through other dielectric portions of rear housing wall 12R. The aperture may be overlapped by a dielectric cover layer or dielectric coating that extends across the lateral area of rear housing wall 12R (e.g., between peripheral conductive housing structures 12W). Phased antenna array 54-1 may perform beam steering for radio-frequency signals 60 across the hemisphere below device 10, as shown by arrow 62.

Phased antenna array 54-1 may be mounted to a substrate such as substrate 64. Substrate 64 may be an integrated circuit chip, a flexible printed circuit, a rigid printed circuit board, or other substrate. Substrate 64 may sometimes be referred to herein as antenna module 64. If desired, transceiver circuitry (e.g., millimeter/centimeter wave transceiver circuitry 38 of FIG. 2) may be mounted to antenna module 64. Phased antenna array 54-1 may be adhered to rear housing wall 12R using adhesive, may be pressed against (e.g., in contact with) rear housing wall 12R, or may be spaced apart from rear housing wall 12R.

The field of view of phased antenna array 54-1 is limited to the hemisphere under the rear face of device 10. Display module 68 and other components 58 (e.g., portions of input-output circuitry 24 or control circuitry 28 of FIG. 2, a battery for device 10, etc.) in device 10 include conductive structures. If care is not taken, these conductive structures may block radio-frequency signals from being conveyed by a phased antenna array within device 10 across the hemisphere over the front face of device 10. While an additional phased antenna array for covering the hemisphere over the front face of device 10 may be mounted against display cover layer 56 within inactive area IA, there may be insufficient space between the lateral periphery of display module 68 and peripheral conductive housing structures 12W to form all of the circuitry and radio-frequency transmission lines necessary to fully support the phased antenna array. In order to mitigate these issues and provide coverage through the front face of device 10, a front-facing phased antenna array may be mounted within peripheral region 66 of device 10. The antennas in the front-facing phased antenna array may include dielectric resonator antennas. Dielectric resonator antennas may occupy less area in the X-Y plane of FIG. 5 than other types of antennas such as patch antennas and slot antennas. Implementing the antennas as dielectric resonator antennas may allow the radiating elements of the front-facing phased antenna array to fit within inactive area IA between display module 68 and peripheral conductive housing structures 12W. At the same time, the radio-frequency transmission lines and other components for the phased antenna array may be located behind (under) display module 68.

Figure 6:
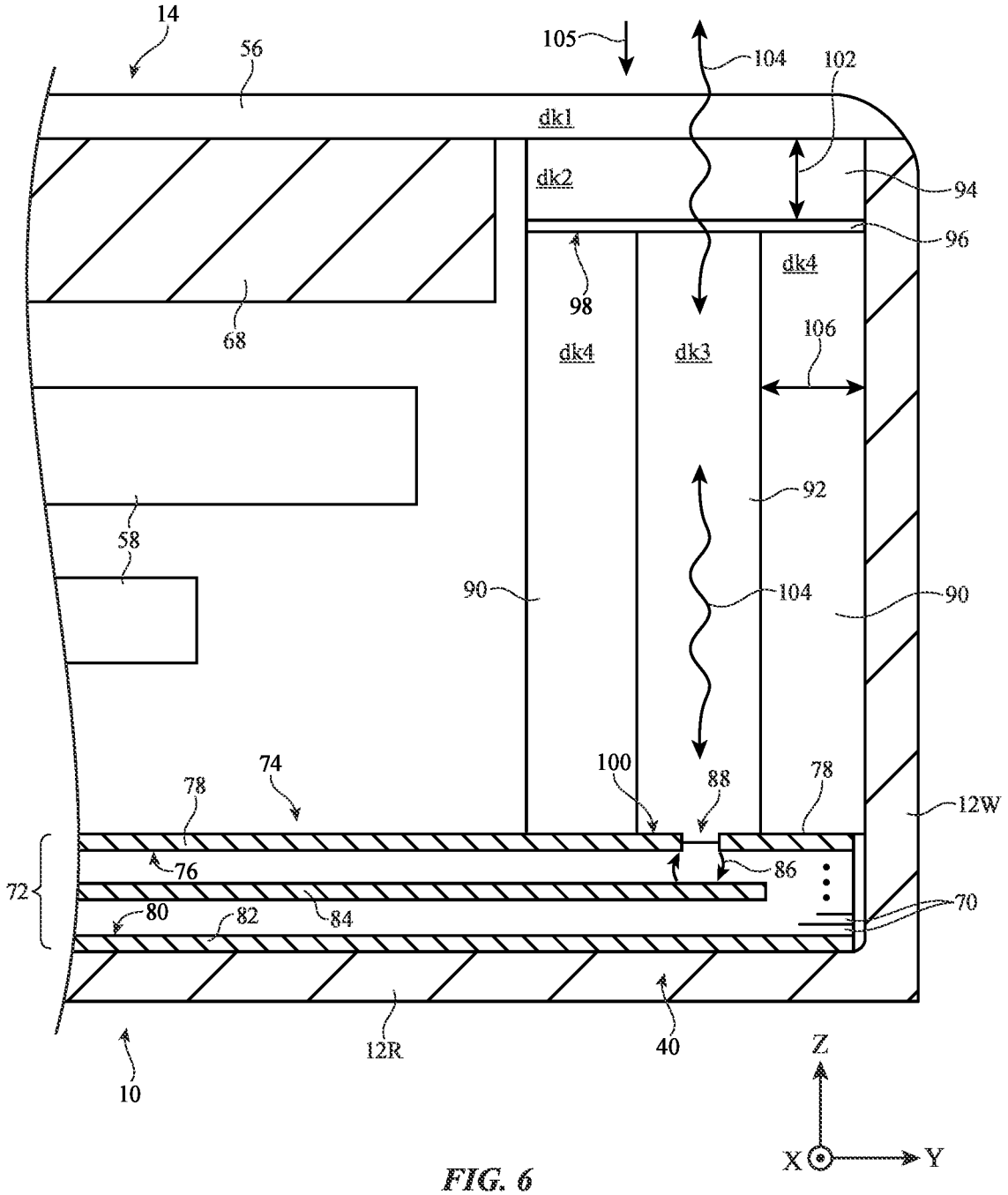
FIG. 6 is a cross-sectional side view of an illustrative dielectric resonator antenna that may be mounted within an electronic device in accordance with some embodiments.

FIG. 6 is a cross-sectional side view of an illustrative dielectric resonator antenna in a front-facing phased antenna array for device 10. As shown in FIG. 6, device 10 may include a front-facing phased antenna array having a given antenna 40 (e.g., mounted within peripheral region 66 of FIG. 5). Antenna 40 of FIG. 6 may be a dielectric resonator antenna. In this example, antenna 40 may include a dielectric resonating element 92 mounted to an underlying substrate such as flexible printed circuit 72. This example is merely illustrative and, if desired, flexible printed circuit 72 may be replaced with a rigid printed circuit board, a plastic substrate, or any other desired substrate.

Flexible printed circuit 72 has a lateral area (e.g., in the X-Y plane of FIG. 6) that extends along rear housing wall 12R. Flexible printed circuit 72 may be adhered to rear housing wall 12R using adhesive, may be pressed against (e.g., placed in contact with) rear housing wall 12R, or may be separated from rear housing wall 12R. Flexible printed circuit 72 may have a first end at antenna 40 and an opposing second end coupled to the millimeter/centimeter wave transceiver circuitry in device 10 (e.g., millimeter/centimeter wave transceiver circuitry 38 of FIG. 2). In one suitable arrangement, the second end of flexible printed circuit 72 may be coupled to antenna module 64 of FIG. 5.

As shown in FIG. 6, flexible printed circuit 72 may include stacked dielectric layers 70. Dielectric layers 70 may include polyimide, ceramic, liquid crystal polymer, plastic, and/or any other desired dielectric materials. Conductive traces such as conductive traces 78 may be patterned on a top surface 76 of flexible printed circuit 72. Conductive traces such as conductive traces 82 may be patterned on an opposing bottom surface 80 of flexible printed circuit 72. Conductive traces 78 and 82 may be held at a ground potential and may therefore sometimes be referred to herein as ground traces 78 and 82. Ground traces 78 may be shorted to ground traces 82 using conducive vias that extend through flexible printed circuit 72 (not shown in FIG. 6 for the sake of clarity). Ground traces 78 and 82 may form part of the antenna ground for antenna 40, for example. Ground traces 78 and 82 may be coupled to a system ground in device 10 (e.g., using solder, welds, conductive adhesive, conductive tape, conductive brackets, conductive pins, conductive screws, conductive clips, combinations of these, etc.). For example, ground traces 78 and 82 may be coupled to peripheral conductive housing structures 12W, conductive portions of rear housing wall 12R, or other grounded structures in device 10. The example of FIG. 6 in which ground traces 78 are formed on top surface 76 and ground traces 82 are formed on bottom surface 80 of flexible printed circuit 72 is merely illustrative. If desired, one or more dielectric layers 70 may be layered over ground traces 78 and/or one or more dielectric layers 70 may be layered under ground traces 82.

Antenna 40 may be fed using a radio-frequency transmission line (e.g., radio-frequency transmission line 42 of FIG. 3) that is embedded within flexible printed circuit 72 such as stripline 74. Stripline 74 may include ground traces 78 and 82 and conductive traces 84 extending between ground traces 78 and 82. Conductive traces 84 may be patterned onto a dielectric layer 70 between ground traces 78 and 82 in flexible printed circuit 72. The portion of ground traces 78 and 82 overlapping conductive traces 84 may form the ground conductor for stripline 74 (e.g., ground conductor 48 of FIG. 3). Conductive traces 84 may form the signal conductor for stripline 74 (e.g., signal conductor 46 of FIG. 3) and may therefore sometimes be referred to herein as signal traces 84. Stripline 74 may convey radio-frequency signals between antenna 40 and the millimeter/centimeter wave transceiver circuitry. The example of FIG. 6 in which antenna 40 is fed using a stripline is merely illustrative. In general, antenna 40 may be fed using any desired transmission line structures in flexible printed circuit 72.

Dielectric resonating element 92 of antenna 40 may be formed from a column (pillar) of dielectric material mounted to top surface 76 of flexible printed circuit 72. Dielectric resonating element 92 may be embedded within (e.g., laterally surrounded by) a dielectric substrate mounted to top surface 76 of flexible printed circuit 72 such as dielectric substrate 90. Dielectric substrate 90 and dielectric resonating element 92 extend from a bottom surface 100 at flexible printed circuit 72 to an opposing top surface 98 at display 14.

The radiating frequency of antenna 40 may be selected by adjusting the dimensions of dielectric resonating element 92 (e.g., in the direction of the X, Y, and/or Z axes of FIG. 6). Dielectric resonating element 92 may be formed from a column of dielectric material having dielectric constant $d_{k3}$. Dielectric constant $d_{k3}$ may be relatively high (e.g., greater than 10.0, greater than 12.0, greater than 15.0, greater than 20.0, between 15.0 and 40.0, between 10.0 and 50.0, between 18.0 and 30.0, between 12.0 and 45.0, etc.). In one suitable arrangement, dielectric resonating element 92 may be formed from zirconia or a ceramic material. Other dielectric materials may be used to form dielectric resonating element 92 if desired.

Dielectric substrate 90 may be formed from a material having dielectric constant $d_{k4}$. Dielectric constant $d_{k4}$ may be less than dielectric constant $d_{k3}$ of dielectric resonating element 92 (e.g., less than 18.0, less than 15.0, less than 10.0, between 3.0 and 4.0, less than 5.0, between 2.0 and 5.0, etc.). Dielectric constant $d_{k4}$ may be greater than dielectric constant $d_{k3}$ by at least 10.0, 5.0, 15.0, 12.0, 6.0, etc. In one suitable arrangement, dielectric substrate 90 may be formed from molded plastic. Other dielectric materials may be used to form dielectric substrate 90 if desired. The difference in dielectric constant between dielectric resonating element 92 and dielectric substrate 90 may establish a radio-frequency boundary condition between dielectric resonating element 92 and dielectric substrate 90 from bottom surface 100 to top surface 98. This may configure dielectric resonating element 92 to serve as a waveguide for propagating radio-frequency signals at millimeter and centimeter wave frequencies.

Dielectric substrate 90 may have a width (thickness) 106 on each side of dielectric resonating element 92. Width 106 may be selected to isolate dielectric resonating element 92 from peripheral conductive housing structures 12W and to minimize signal reflections in dielectric substrate 90. Width 106 may be, for example, at least one-tenth of the effective wavelength of the radio-frequency signals in a dielectric material of dielectric constant $d_{k4}$. Width 106 may be 0.4-0.5 mm, 0.3-0.5 mm, 0.2-0.6 mm, greater than 0.1 mm, greater than 0.3 mm, 0.2-2.0 mm, 0.3-1.0 mm, or greater than between 0.4 and 0.5 mm, as examples.

As shown in FIG. 6, ground traces 78 may include a slot or opening such as slot 88. Signal traces 84 in stripline 74 may indirectly feed radio-frequency signals for slot 88 via near-field electromagnetic coupling 86 (e.g., the end of signal traces 84 and slot 88 may form antenna feed 44 of FIG. 3). Slot 88 may electromagnetically couple the radio-frequency signals on stripline 74 into dielectric resonating element 92 (e.g., slot 88 may couple the electric field produced by signal traces 84 to the electric field in the volume of dielectric resonating element 92). This may serve to excite one or more electromagnetic modes (e.g., radio-frequency cavity or waveguide modes) of dielectric resonating element 92. When excited by slot 88, the electromagnetic modes of dielectric resonating element 92 may configure the dielectric resonating element to serve as a waveguide that propagates the wavefronts of radio-frequency signals 104 along the length of dielectric resonating element 92 (e.g., in the direction of the Z-axis of FIG. 6), through top surface 98, and through display 14.

For example, during signal transmission, stripline 74 may convey radio-frequency signals from the millimeter/centimeter wave transceiver circuitry to antenna 40. Slot 88 may couple the radio-frequency signals on signal traces 84 into dielectric resonating element 92. This may serve to excite one or more electromagnetic modes of dielectric resonating element 92, resulting in the propagation of radio-frequency signals 104 up the length of dielectric resonating element 92 and to the exterior of device 10 through display cover layer 56. Similarly, during signal reception, radio-frequency signals 104 may be received through display cover layer 56. The received radio-frequency signals may excite the electromagnetic modes of dielectric resonating element 92, resulting in the propagation of the radio-frequency signals down the length of dielectric resonating element 92. Slot 88 may couple the received radio-frequency signals into stripline 74, which conveys the radio-frequency signals to the millimeter/centimeter wave transceiver circuitry. The relatively large difference in dielectric constant between dielectric resonating element 92 and dielectric substrate 90 may allow dielectric resonating element 92 to radiate radio-frequency signals 104 with a relatively high antenna efficiency (e.g., by establishing a strong boundary between dielectric resonating element 92 and dielectric substrate 90 for the radio-frequency signals). The relatively high dielectric constant of dielectric resonating element 92 may also allow the dielectric resonating element 92 to occupy a relatively small volume compared to scenarios where materials with a lower dielectric constant are used.

The length of slot 88 (e.g., in the direction of the X-axis of FIG. 6) may be selected to optimize electromagnetic coupling between stripline 74 and dielectric resonating element 92. If desired, slot 88 may feed (excite) dielectric resonating element 92 without radiating the radio-frequency signals itself. The orientation of slot 88 relative to dielectric resonating element 92 may be selected to provide antenna 40 with a desired linear polarization (e.g., a vertical or horizontal polarization). Slot 88 may sometimes be referred to herein as coupling slot 88, feed slot 88, or slot element 88. Dielectric resonating element 92 may sometimes be referred to herein as a dielectric radiating element, dielectric radiator, dielectric resonator, dielectric antenna resonating element, dielectric column, dielectric pillar, radiating element, or resonating element.

Display cover layer 56 may be formed from a dielectric material having dielectric constant $d_{k1}$ that is less than dielectric constant $d_{k3}$. For example, dielectric constant may be between about 3.0 and 10.0 (e.g., between 4.0 and 9.0, between 5.0 and 8.0, between 5.5 and 7.0, between 5.0 and 7.0, etc.). In one suitable arrangement, display cover layer 56 may be formed from glass, plastic, or sapphire. If care is not taken, the relatively large difference in dielectric constant between display cover layer 56 and dielectric resonating element 92 may cause undesirable signal reflections at the boundary between the display cover layer and the dielectric resonating element. These reflections may result in destructive interference between the transmitted and reflected signals and in stray signal loss that undesirably limits the antenna efficiency of antenna 40.

In order to mitigate effects, antenna 40 may be provided with an impedance matching layer such as dielectric matching layer 94. Dielectric matching layer 94 may be mounted to top surface 98 of dielectric resonating element 92 between dielectric resonating element 92 and display cover layer 56. If desired, dielectric matching layer 94 may be adhered to dielectric resonating element 92 using a layer of adhesive 96. Adhesive may also or alternatively be used to adhere dielectric matching layer 94 to display cover layer 56 if desired. Adhesive 96 may be relatively thin so as not to significantly affect the propagation of radio-frequency signals 104.

Dielectric matching layer 94 may be formed from a dielectric material having dielectric constant $d_{k2}$. Dielectric constant $d_{k2}$ may be greater than dielectric constant $d_{k1}$ and less than dielectric constant $d_{k3}$. As an example, dielectric constant $d_{k2}$ may be equal to $SQRT(d_{k1}*d_{k3})$, where SQRT( ) is the square root operator and "*" is the multiplication operator. The presence of dielectric matching layer 94 may allow radio-frequency signals to propagate without facing a sharp boundary between the material of dielectric constant $d_{k1}$ and the material of dielectric constant $d_{k3}$, thereby helping to reduce signal reflections.

Dielectric matching layer 94 may be provided with thickness 102. Thickness 102 may be selected to be approximately equal to (e.g., within 15% of) one-quarter of the effective wavelength of radio-frequency signals 104 in dielectric matching layer 94. The effective wavelength is given by dividing the free space wavelength of radio-frequency signals 104 (e.g., a centimeter or millimeter wavelength corresponding to a frequency between 10 GHz and 300 GHz) by a constant factor (e.g., the square root of $d_{k3}$). When provided with thickness 102, dielectric matching layer 94 may form a quarter wave impedance transformer that mitigates any destructive interference associated with the reflection of radio-frequency signals 104 at the boundaries between display cover layer 56, dielectric matching layer 94, and dielectric resonating element 92.

When configured in this way, antenna 40 may radiate radio-frequency signals 104 through the front face of device 10 despite being coupled to the millimeter/centimeter wave transceiver circuitry over a flexible printed circuit located at the rear of device 10. The relatively narrow width of dielectric resonating element 92 may allow antenna 40 to fit in the volume between display module 68, other components 58, and peripheral conductive housing structures 12W. Antenna 40 of FIG. 6 may be formed in a front-facing phased antenna array that conveys radio-frequency signals across at least a portion of the hemisphere above the front face of device 10.

Figure 7:
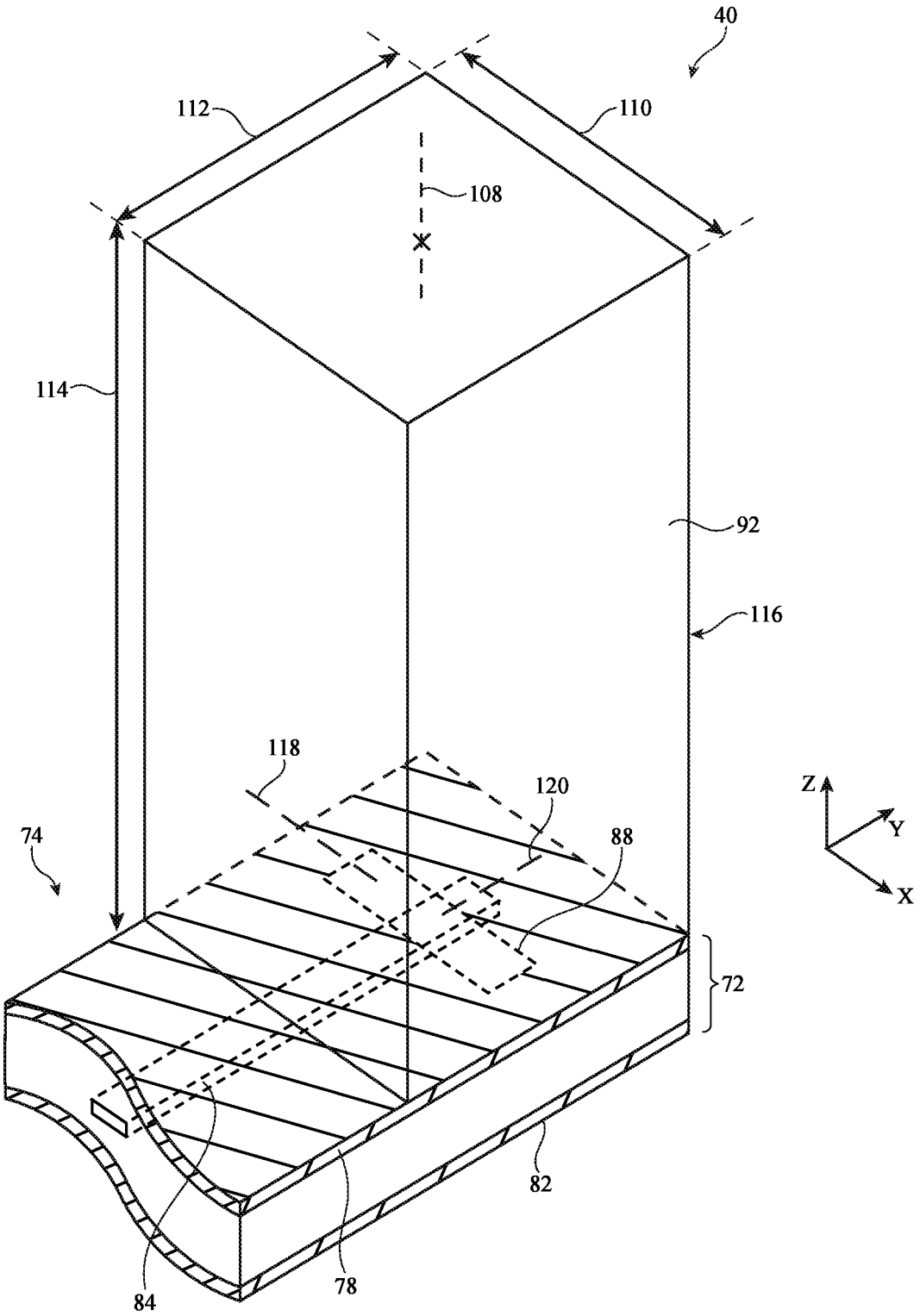
FIG. 7 is a perspective view of an illustrative dielectric resonator antenna in accordance with some embodiments.

FIG. 7 is a perspective view of the dielectric resonator antenna of FIG. 6. Peripheral conductive housing structures 12W, dielectric substrate 90, dielectric matching layer 94, adhesive 96, rear housing wall 12R, display 14, and other components 58 of FIG. 6 are omitted from FIG. 7 for the sake of clarity.

As shown in FIG. 7, dielectric resonating element 92 of antenna 40 is mounted to flexible printed circuit 72. Slot 88 in ground traces 78 may be aligned with longitudinal (central) axis 108 of dielectric resonating element 92. Slot 88 may extend along a longitudinal axis 118 parallel to the X-axis of FIG. 7. Signal traces 84 of stripline 74 may extend along a longitudinal axis 120 that is perpendicular to longitudinal axis 118. Longitudinal axes 118 and 120 are perpendicular to longitudinal axis 108 of dielectric resonating element 92. When oriented in this way, antenna 40 may convey radio-frequency signals (e.g., radio-frequency signals 104 of FIG. 6) with a desired linear polarization (e.g., the electric field of the radio-frequency signals may be aligned with the Y-axis of FIG. 7). In another suitable arrangement, signal traces 84 may extend along longitudinal axis 118 and slot 88 may extend along longitudinal axis 120 to configure antenna 40 to convey radio-frequency signals with an orthogonal linear polarization (e.g., where the electric field of the radio-frequency signals is aligned with the X-axis of FIG. 7).

Dielectric resonating element 92 may have a length 110, width 112, and height 114. Length 110, width 112, and height 114 may be selected to provide dielectric resonating element 92 with a corresponding mix of electromagnetic cavity/waveguide modes that, when excited by slot 88, configure antenna 40 to radiate at desired frequencies. For example, height 114 may be 2-10 mm, 4-6 mm, 3-7 mm, 4.5-5.5 mm, or greater than 2 mm. Width 112 and length 110 may each be 0.5-1.0 mm, 0.4-1.2 mm, 0.7-0.9 mm, 0.5-2.0 mm, 1.5 mm-2.5 mm, 1.7 mm-1.9 mm, 1.0 mm-3.0 mm, etc. Width 112 may be equal to length 110 or, in other arrangements, may be different than length 110. Dielectric resonating element 92 may have sidewalls 116. Sidewalls 116 may contact the surrounding dielectric substrate (e.g., dielectric substrate 90 of FIG. 6). The example of FIG. 7 is merely illustrative and, if desired, dielectric resonating element 92 may have other shapes (e.g., shapes with any desired number of straight and/or curved sidewalls 116).

Figure 8:
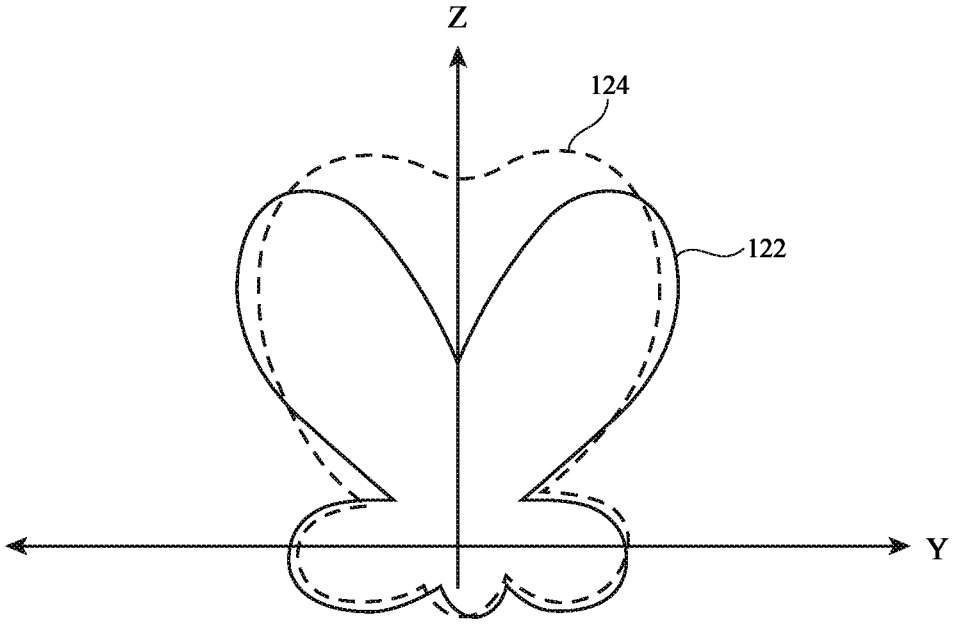
FIG. 8 is a diagram of radiation patterns for an illustrative dielectric resonator antenna in the presence and absence of a dielectric matching layer in accordance with some embodiments.

FIG. 8 shows a cross-sectional side view of an illustrative radiation pattern for antenna 40 in the presence and absence of dielectric matching layer 94 of FIG. 6. As shown in FIG. 8, curve 122 illustrates a radiation pattern of antenna 40 in scenarios where the dielectric matching layer is omitted. As shown by curve 122, the radiation pattern may exhibit lobes of peak gain separated by a gain minimum at boresight. This minimum may be the result of signal reflections and destructive interference between the dielectric resonating element and the display cover layer.

When antenna 40 is provided with dielectric matching layer 94 of FIG. 6, antenna 40 may exhibit a radiation pattern as illustrated by curve 124. As shown by curve 124, the dielectric matching layer may serve to merge the gain peaks of curve 122 together to create a more uniform radiation pattern with greater gain at boresight. In other words, the dielectric matching layer may optimize the radiation pattern for antenna 40 by providing a smooth transition between the dielectric material of the dielectric resonating element and the dielectric material of the display cover layer.

The example of FIG. 8 is merely illustrative. In general, curve 124 may exhibit other shapes. The radiation pattern shown in FIG. 8 illustrate a two-dimensional cross-sectional side view of the radiation pattern. In general, the radiation pattern for antenna 40 is three-dimensional.

Figure 9:
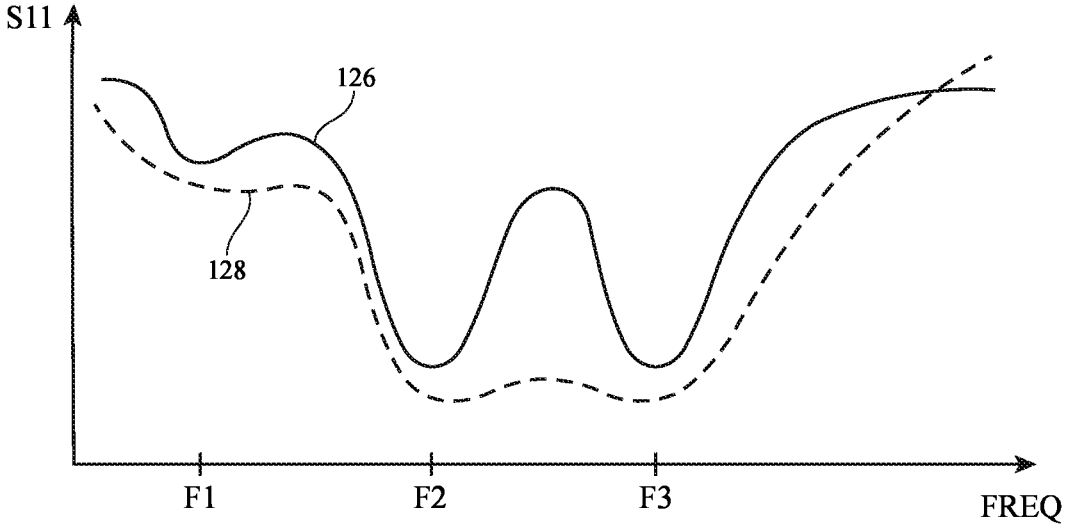
FIG. 9 is a plot of antenna performance (return loss) for an illustrative dielectric resonator antenna in the presence and absence of a dielectric matching layer in accordance with some embodiments.

FIG. 9 is a plot of antenna performance as a function of frequency for antenna 40 in the presence and absence of dielectric matching layer 94 of FIG. 6. As shown in FIG. 9, curve 126 plots the return loss (e.g., scattering coefficient S11) of antenna 40 in the absence of dielectric matching layer 94. As shown by curve 126, antenna 40 may exhibit response peaks at multiple frequencies such as frequencies F1, F2, and F3. Each response peak may be associated with a corresponding electromagnetic mode of dielectric resonating element 92 (e.g., an electromagnetic mode excited by slot 88 of FIG. 6). The dimensions of dielectric resonating element 92 (e.g., length 110, width 112, and height 114 of FIG. 7) may be selected to tune the response peaks to different desired frequencies.

Curve 128 plots the return loss of antenna 40 in the presence of dielectric matching layer 94. As shown by curve 128, antenna 40 may exhibit stronger responses at frequencies F1, F2, and F3 as well as at other frequencies between frequencies F1 and F3 (e.g., antenna 40 may exhibit satisfactory antenna efficiency over a wider bandwidth) relative to scenarios where the dielectric matching layer is omitted. In this way, dielectric matching layer 94 may configure antenna 40 to exhibit a uniform radiation pattern (e.g., as shown by curve 124 of FIG. 8) over a wider range of frequencies (e.g., from frequency F1 to F3) relative to scenarios where the dielectric matching layer is omitted. The example of FIG. 9 is merely illustrative. In general, curve 128 may have other shapes and may exhibit any desired number of response peaks at any desired frequencies.

FIG. 10 is a top-down view showing how multiple dielectric resonator antennas may be integrated into a front-facing phased antenna array in device 10 (e.g., as taken in the direction of arrow 105 of FIG. 6). As shown in FIG. 10, multiple antennas 40 (e.g., dielectric resonator antennas of the type shown in FIGS. 6 and 7) may be arranged in a corresponding phased antenna array such as front-facing phased antenna array 54-2. As shown in FIG. 10, phased antenna array 54-2 may include at least three antennas 40 each fed using a corresponding stripline 74 and slot 88 in flexible printed circuit 72. Each antenna 40 in phased antenna array 54-2 includes a corresponding dielectric resonating element 92. In the example of FIG. 10, each dielectric resonating element 92 in phased antenna array 54-2 is embedded within the same dielectric substrate 90. This is merely illustrative and, if desired, two or more dielectric resonating elements 92 may be embedded in different substrates.

Each antenna 40 in phased antenna array 54-2 may be laterally separated from one or two adjacent antennas 40 in the phased antenna array by distance 131. Distance 131 may be selected to allow the antennas in phased antenna array 54-2 to collectively convey radio-frequency signals over a corresponding signal beam. For example, distance 131 may be approximately one-half of the free-space wavelength of operation of phased antenna array 54-2 (e.g., a free-space wavelength corresponding to a frequency in a frequency band of operation for phased antenna array 54-2). Distance 131 may be 3-5 mm, 2-6 mm, 3.5-4.5 mm, or 1-4 mm, as examples.

In the example of FIG. 10, each antenna 40 in phased antenna array 54-2 is provided with the same linear polarization. If desired, one or more antennas 40 in phased antenna array 54-2 may be provided with an orthogonal linear polarization. For example, a first set of antennas 40 in phased antenna array 54-2 may convey radio-frequency signals with a vertical polarization whereas a second set of antennas 40 in phased antenna array 54-2 may convey radio-frequency signals with a horizontal polarization. The antennas in the first set may be interleaved among the antennas in the second set if desired.

In the example of FIG. 10, slots 88 have a length 130 and width 132 that are selected to maximize electromagnetic coupling between the corresponding stripline 74 (e.g., signal traces 84) and the corresponding dielectric resonating element 92. In another suitable arrangement, length 130 and width 132 may be selected so that the slots also radiate radio-frequency signals for antennas 40 in addition to exciting dielectric resonating elements 92. The slots may radiate when length 130 is approximately equal to one-half of the effective wavelength of operation for antennas 40, for example. When the slots are configured to radiate in this way, the slots may form a slot antenna resonating element for antennas 40 (e.g., antennas 40 may by hybrid slot and dielectric resonator antennas). The slot antenna resonating elements may contribute to the overall frequency response of antennas 40.

Figure 11:
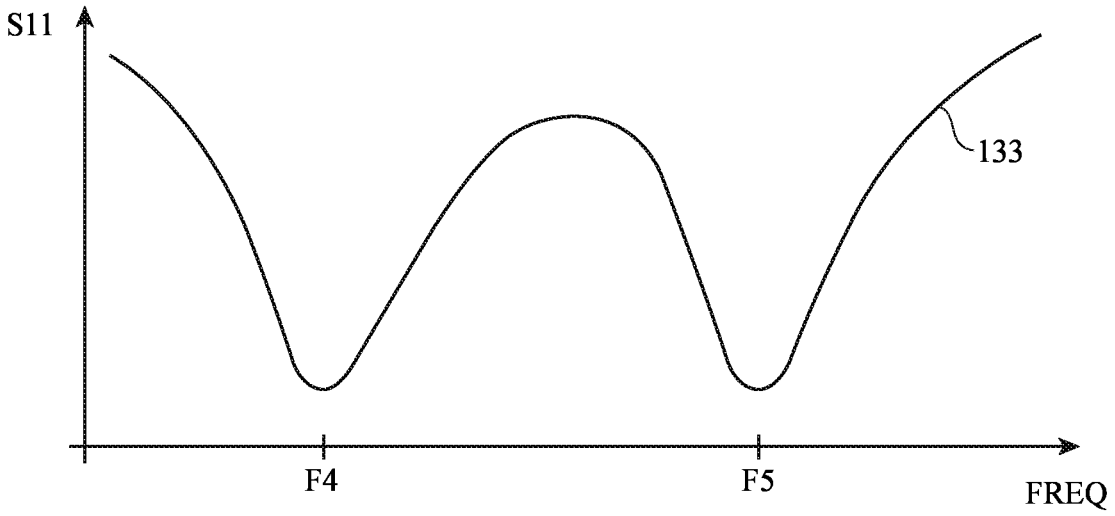
FIG. 11 is a plot of antenna performance (return loss) for an illustrative dielectric resonator antenna that is fed by a radiating slot in accordance with some embodiments.

FIG. 11 is a plot of antenna performance (return loss) as a function of frequency for antenna 40 in an arrangement where the slot that feeds the dielectric resonating element is also configured to radiate radio-frequency signals as a slot antenna resonating element. As shown by curve 133 of FIG. 11, antenna 40 may exhibit a first response peak (mode) at frequency F4 and a second response peak (mode) at frequency F5. The response peak at frequency F5 may be produced by dielectric resonating element 92 (e.g., frequency F5 may be determined by length 110, width 112, and height 114 of dielectric resonating element 92 as shown in FIG. 7). The response peak at frequency F4 may be produced by the slot antenna resonating element (e.g., frequency F4 may be determined by the perimeter of the slot antenna resonating element). In this way, the antenna may perform radio-frequency communications at both frequencies F4 and F5 (e.g., in two frequency bands that include frequencies F4 and F5). As an example, frequency F4 may be a frequency between 24 GHz and 28 GHz whereas frequency F5 is a frequency between 30 GHz and 34 GHz.

This example is merely illustrative. In another suitable arrangement, the response peak at frequency F5 may be produced by the slot antenna resonating element whereas the response peak at frequency F4 is produced by the dielectric resonating element. Curve 133 may have other shapes and may exhibit more than two response peaks if desired. Frequencies F4 and F5 may include any desired frequencies between 10 GHz and 300 GHz.

In scenarios where antenna 40 covers multiple frequency bands (e.g., scenarios where antenna 40 is provided with a radiating slot antenna element in addition to dielectric resonating element 92 for covering frequencies F4 and F5 of FIG. 11), dielectric matching layer 94 of FIG. 6 may not be capable of performing impedance matching between the dielectric resonator antenna and the display cover layer with sufficient bandwidth to cover each frequency band handled by antenna 40. If desired, antenna 40 may be provided with a tapered dielectric matching layer. The tapered dielectric matching layer may perform impedance matching between the dielectric resonator antenna and the display cover layer over a sufficiently wide bandwidth to cover each frequency band handled by antenna 40.

Figure 12:
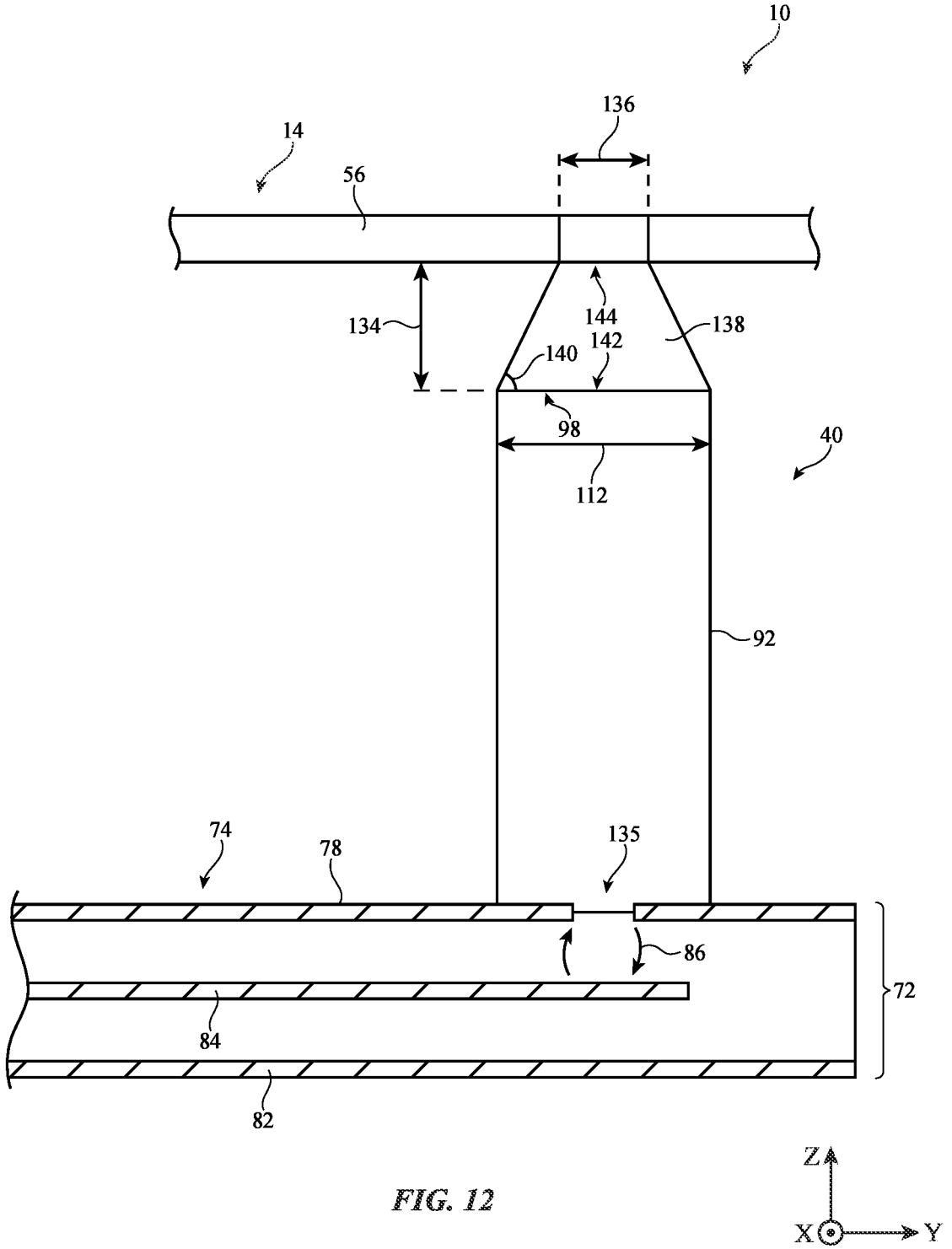
FIG. 12 is a cross-sectional side view of an illustrative dielectric resonator antenna that is fed by a radiating slot and that has a tapered dielectric matching layer in accordance with some embodiments.

FIG. 12 is a cross-sectional side view of device 10 in a scenario where antenna 40 is provided with a radiating slot and a tapered dielectric matching layer. In the example of FIG. 12, other components 58, display module 68, dielectric substrate 90, rear housing wall 12R, adhesive 96, and peripheral conductive housing structures 12W of FIG. 6 are omitted from FIG. 12 for the sake of clarity.

As shown in FIG. 12, a radiating slot such as radiating slot 135 may be formed in ground traces 78 on flexible printed circuit 72. Radiating slot 135 (e.g., a slot 88 of FIG. 6 that has been provided with a perimeter that configures the slot element to radiate radio-frequency as a slot antenna resonating element) may be indirectly fed by signal traces 84 of stripline 74 via near-field electromagnetic coupling 86. A tapered dielectric matching layer such as tapered dielectric matching layer 138 may be mounted to dielectric resonating element 92 (e.g., bottom surface 142 of tapered dielectric matching layer 138 may be mounted to top surface 98 of dielectric resonating element 92). Display cover layer 56 may be mounted over top surface 144 of tapered dielectric matching layer 138. A layer of adhesive (not shown for the sake of clarity) may be used to adhere top surface 144 to display cover layer 56 and/or to adhere bottom surface 142 to dielectric resonating element 92. Adhesive may be omitted if desired.

Stripline 74 may convey radio-frequency signals in a first frequency band (e.g., a frequency band at frequency F4 of FIG. 11) and a second frequency band (e.g., a frequency band at frequency F5 of FIG. 11). The radio-frequency signals may induce antenna currents in the first frequency band to flow through ground traces 78 and around the perimeter of radiating slot 135 (e.g., in the X-Y plane of FIG. 12). Radiating slot 135 may radiate corresponding radio-frequency signals in the first frequency band through dielectric resonating element 92, tapered dielectric matching layer 138, and display cover layer 56. At the same time, radiating slot 135 may excite the resonant modes (e.g., cavity/waveguide modes) of dielectric resonating element 92 in the second frequency band. Corresponding radio-frequency signals in the second frequency band may propagate down the length of dielectric resonating element 92, through tapered dielectric matching layer 138, and through display cover layer 56.

If desired, tapered dielectric matching layer 138 may be formed from the same material as dielectric matching layer 94 of FIG. 6 (e.g., a dielectric material having dielectric constant $d_{k2}$). The presence of tapered dielectric matching layer 138 may allow radio-frequency signals in both the first and second frequency bands to propagate without facing a sharp impedance discontinuity between dielectric resonating element 92 and display cover layer 56, thereby helping to reduce signal reflections and maximize antenna efficiency in both frequency bands. The dimensions of tapered dielectric matching element 138 may be selected to tune the matching characteristics of tapered dielectric matching layer 138 as a function of frequency, which in turn serves to tune the antenna efficiency of antenna 40 as a function of frequency.

Bottom surface 142 of tapered dielectric matching layer 138 may have width 112 (e.g., the same width as dielectric resonating element 92). Top surface 144 of tapered dielectric matching layer 138 may have width 136. Width 136 is less than width 112. Tapered dielectric matching layer 138 may have height 134 extending from bottom surface 142 to top surface 144. Width 136, width 112, and height 134 may determine the taper angle 140 of tapered dielectric matching layer 138. Width 136, height 134, and/or taper angle 140 may be selected to tune the matching characteristics of dielectric matching layer 138 and thus the frequency response of antenna 40 in the presence of display cover layer 56. As an example, width 136 may be between 0.8 mm and 1.2 mm, between 0.7 mm and 1.3 mm, between 0.9 mm and 1.1 mm, greater than 1.3 mm, less than 0.7 mm, or other lengths that are less than width 112 of dielectric resonating element 92. Height 134 may be 0.5-3.5 mm, 1.0 mm-3.0 mm, 1.5-2.5 mm, or other heights. For a fixed width 112, height 134 and width 136 may determine taper angle 140.

Figure 13:
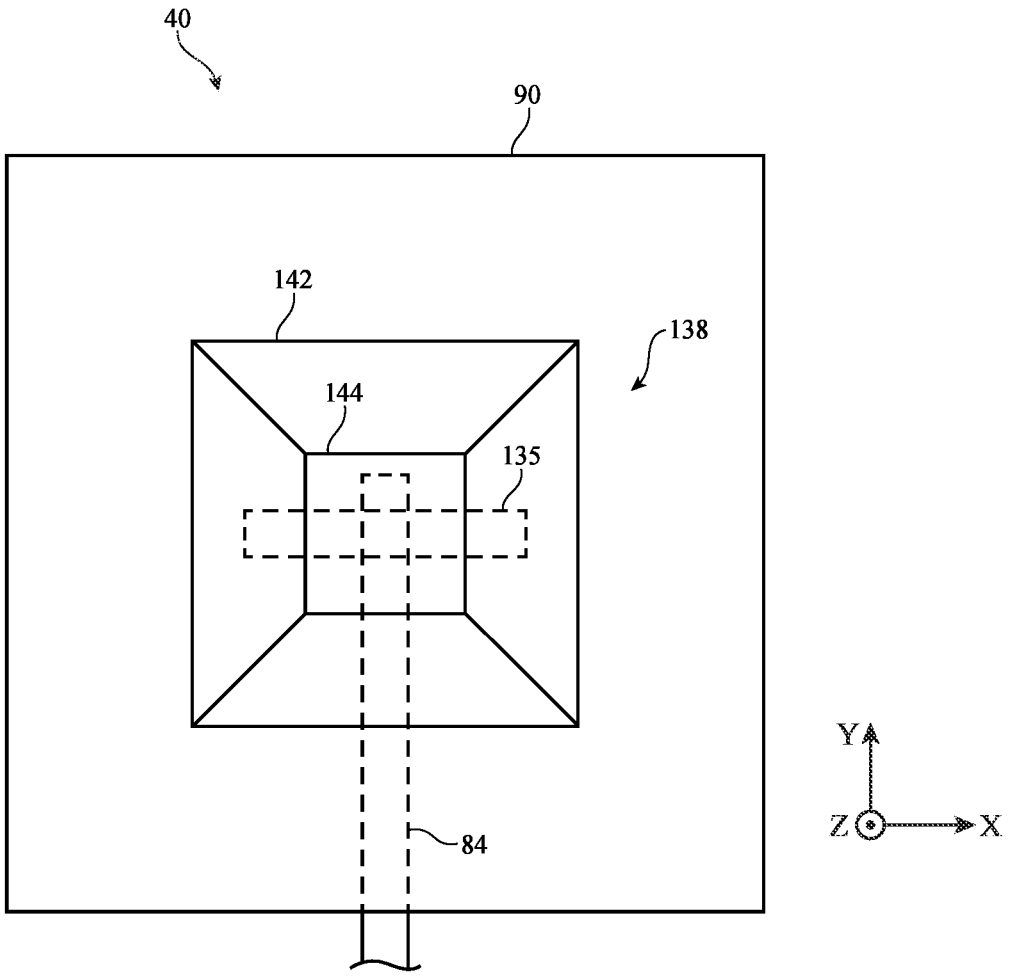
FIG. 13 is a top-down view of an illustrative tapered dielectric matching layer on an underlying dielectric resonator antenna in accordance with some embodiments.

FIG. 13 is a top-down view of tapered dielectric matching layer 138 on antenna 40. As shown in FIG. 13, tapered dielectric matching layer 138 may be mounted to an underlying dielectric resonating element that is laterally surrounded by dielectric substrate 90 (e.g., tapered dielectric matching layer 138 may protrude above dielectric substrate 90 in the direction of the Z-axis of FIG. 13). Tapered dielectric matching layer 138 has a tapered shape extending from bottom surface 142 at the underlying dielectric resonating element to top surface 144. Tapered dielectric matching layer 138 may overlap the underlying radiating slot 135, which is fed by signal traces 84 of the corresponding stripline.

The example of FIGS. 12 and 13 are merely illustrative. If desired, tapered dielectric matching layer 138 may have other shapes (e.g., shapes having any desired number of curved and/or straight edges, cylindrical shapes, conical shapes, combinations of these, etc.). The underlying radiating slot may be oriented at other angles with respect to tapered dielectric matching layer 138 if desired.

Figure 14:
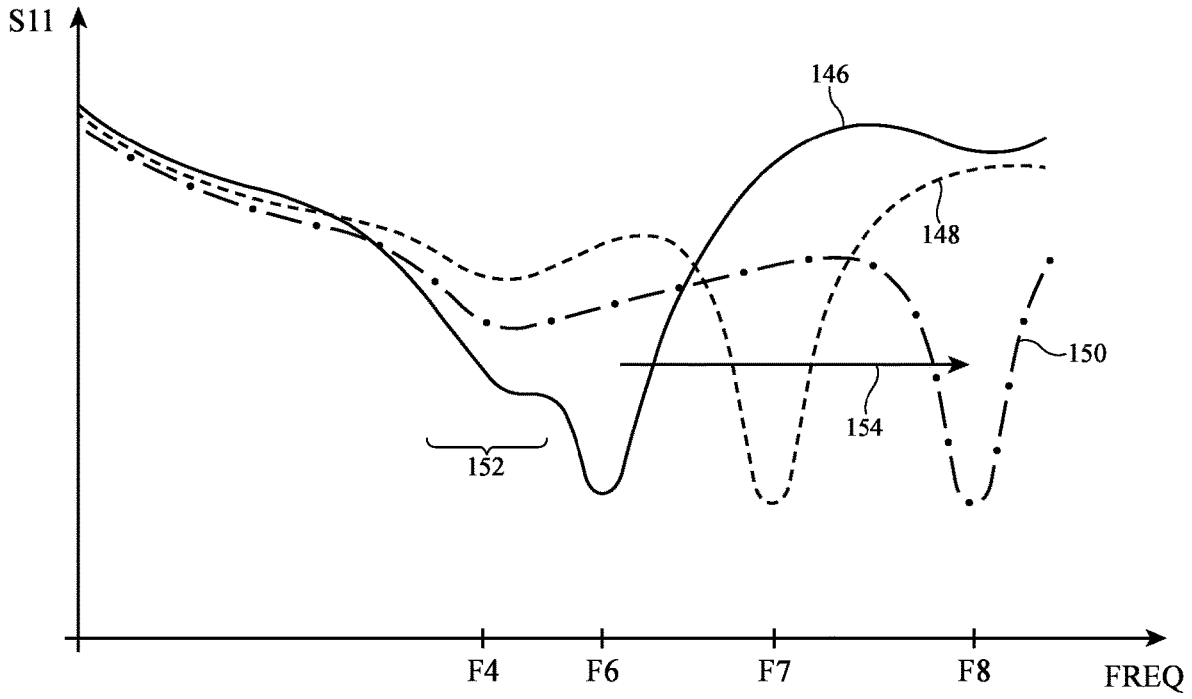
FIG. 14 is a plot of antenna performance (return loss) for an illustrative dielectric resonator antenna that is fed by a radiating slot under different tapered dielectric matching layers in accordance with some embodiments.

FIG. 14 is a plot of antenna performance (return loss) as a function of frequency for an antenna having a radiating slot and a dielectric resonating element such as antenna 40 of FIGS. 12 and 13. As shown in FIG. 14, curves 146, 148, and 150 plot the return loss of antenna 40 when provided with tapered dielectric matching layers 138 having different taper angles (e.g., having fixed widths 136 and 112 but different taper angles 140 and thus different heights 134 as shown in FIG. 12). For example, curve 146 of FIG. 14 may correspond to the performance of antenna 40 when the tapered dielectric matching layer is provided with a first taper angle (e.g., a first height), curve 148 may correspond to the performance of antenna 40 when the tapered dielectric matching layer is provided with a second taper angle (e.g., a second height), and curve 150 may correspond to the performance of antenna 40 when the tapered dielectric matching layer is provided with a third taper angle (e.g., a third height). The first taper angle may be less than the second and third taper angles and the first height may be less than the second and third heights. Similarly, the second taper angle may be less than the third taper angle and the second height may be less than the third height.

As shown by curves 146, 148, and 150, each configuration of the tapered dielectric matching layer may produce a first response peak within frequency band 152 at frequency F4. This response peak may be produced by the slot antenna mode of antenna 40 (e.g., radiating slot 135 of FIGS. 12 and 13 may support a response peak at frequency F4 regardless of taper angle). As shown by curve 146, the first taper angle and first height may configure the tapered dielectric matching layer to provide the antenna with a second response peak in a second frequency band at frequency F6. As shown by curve 148, the second taper angle and second height may configure the tapered dielectric matching layer to provide the antenna with a second response peak in a second frequency band at frequency F7. As shown by curve 150, the third taper angle and third height may configure the tapered dielectric matching layer to provide the antenna with a second response peak in a second frequency band at frequency F8. The response peaks at frequencies F6, F7, and F8 may be produced by the dielectric resonating element mode of antenna 40 (e.g., frequencies F6, F7, and F8 may each be frequency F5 of FIG. 11 depending upon the configuration of the tapered dielectric matching layer). In other words, increasing height 134 and thus taper angle 140 (for fixed widths 136 and 112) may serve to adjust the matching characteristics of the tapered dielectric matching layer to push the frequency response of antenna 40 in the second frequency band higher, as shown by arrow 154. By providing the tapered dielectric matching layer with a suitable shape, the antenna may be configured to radiate with satisfactory antenna efficiency in any two desired frequency bands using both the radiating slot and the dielectric resonating element of the antenna.

The example of FIG. 14 is merely illustrative. If desired, other dimensions of the tapered dielectric matching layer may be adjusted to tune the frequency response of antenna 40. Curves 146, 148, and 150 may have any desired shapes and may exhibit response peaks at any desired frequencies. If the response peak in the second frequency band (e.g., at frequencies F6, F7, or F8) is sufficiently close to the response peak in the first frequency band (e.g., at frequency F4), the antenna may exhibit a continuous response peak with satisfactory antenna efficiency (e.g., an antenna efficiency that exceeds a minimum threshold efficiency) from the lower limit of the first frequency band to the upper limit of the second frequency band.

If desired, a given phased antenna array in device 10 may include different antennas that cover different polarizations (e.g., to provide the phased antenna array with polarization diversity). For example, a given phased antenna array may include a first set of antennas that cover a horizontal polarization and a second set of antennas that cover a vertical polarization. In order to optimize space consumption within the device, the first set of antennas may be interleaved among the second set of antennas in the phased antenna array.

Figure 15:
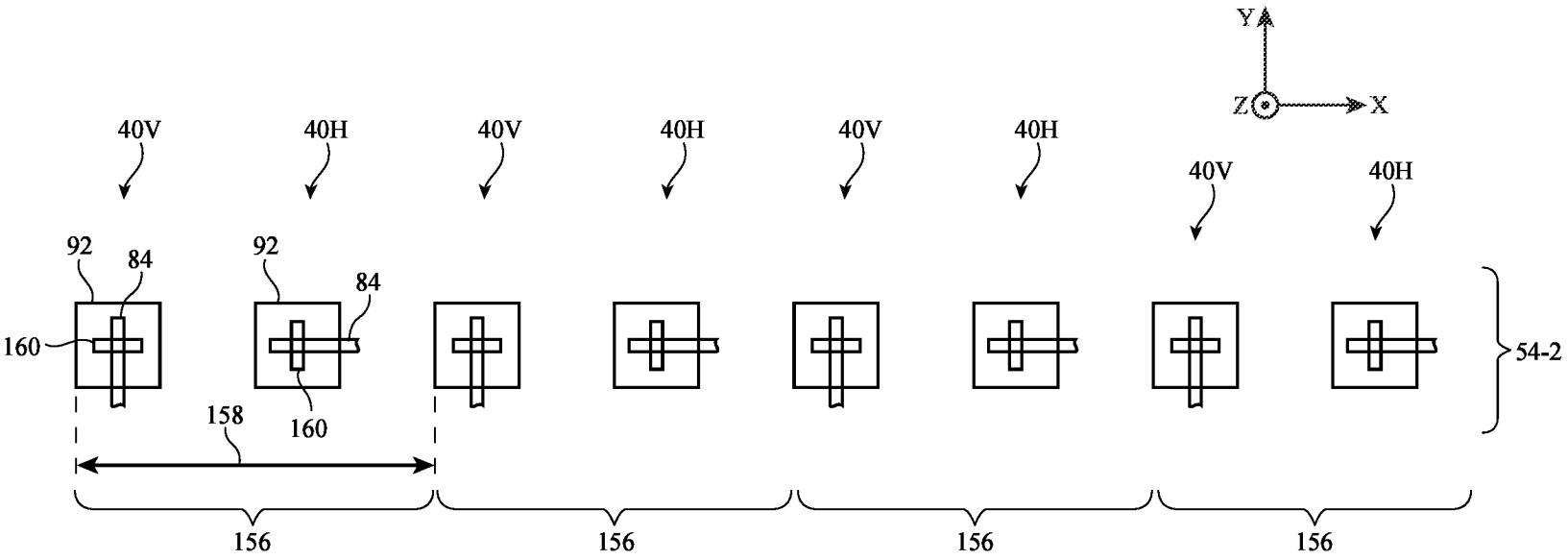
FIG. 15 is a top-down view of an illustrative phased antenna array having interleaved dielectric resonator antennas for handling the same frequencies and different polarizations in accordance with some embodiments.

FIG. 15 is a top-down view of a given phased antenna array 54-2 having antennas for covering both horizontal and vertical polarizations. As shown in FIG. 15, phased antenna array 54-2 may include a first set of antennas 40V that convey radio-frequency signals with a first linear polarization (e.g., a vertical polarization) and a second set of antennas 40H that convey radio-frequency signals with an orthogonal second linear polarization (e.g., a horizontal polarization).

Antennas 40H and 40V may each include a corresponding dielectric resonating element 92 mounted over an underlying slot element 160. Each dielectric resonating element 92 in phased antenna array 54-2 may be mounted within the same dielectric substrate (e.g., dielectric substrate 90 of FIGS. 6 and 10) or may be mounted within two or more dielectric substrates. Slot elements 160 may be non-radiating slots that excite dielectric resonating elements 92 using radio-frequency signals conveyed over the corresponding stripline signal traces 84 (e.g., slot elements 160 may form slots 88 of FIGS. 6, 7, and 10). In this scenario, antennas 40H and 40V may cover frequencies within a single frequency band (e.g., a frequency band from frequency F1 to frequency F3 of FIG. 9), for example. In another suitable arrangement, slot elements 160 may be radiating slots that radiate radio-frequency signals and excite dielectric resonating elements 92 to radiate (e.g., slot elements 160 may form radiating slots 135 of FIGS. 12 and 13). In this scenario, antennas 40H and 40V may cover frequencies in multiple frequency bands (e.g., a first frequency band at frequency F4 and a second frequency band at frequency F5 of FIG. 11). The slot elements 160 and signal traces 84 for antennas 40V may be oriented perpendicular to the slot elements 160 and signal traces 84 for antennas 40H.

Phased antenna array 54-2 may include a repeating pattern of two or more unit cells 156 of antennas (sometimes referred to herein as antenna unit cells 156). Each unit cell 156 may include a corresponding antenna 40V and a corresponding antenna 40H. In the example of FIG. 15, phased antenna array 54-2 has four unit cells 156. This is merely illustrative and, if desired, phased antenna array 54-2 may have more than four unit cells 156 or fewer than four unit cells 156.

In order to allow for satisfactory beam forming, each antenna 40H in phased antenna array 54-2 may be located at approximately one-half of the effective wavelength of operation of antenna 40H from each adjacent antenna 40H in phased antenna array 54-2. Similarly, each antenna 40V may be located at approximately one-half of the effective wavelength of operation of antenna 40V from each adjacent antenna 40V. As shown in FIG. 15, each antenna 40V is separated from one or two adjacent antennas 40V in phased antenna array 54-2 by distance 158. Similarly, each antenna 40H is separated from one or two adjacent antennas 40H by distance 158 (e.g., unit cell 156 may have a width equal to distance 158). Distance 158 may be between 4 mm and 6 mm, between 3 mm and 7 mm, between 3.5 mm and 4.5 mm, approximately 4 mm, etc. Each antenna 40V may be located within the space between adjacent antennas 40H and each antenna 40H may be located in the space between adjacent antennas 40V in phased antenna array 54-2. In general, dielectric resonator antennas such as antennas 40H and 40L may occupy less lateral area than other types of antennas such as slot antennas or patch antennas. By forming antennas 40H and 40L as dielectric resonator antennas, there may be sufficient space between adjacent antennas 40H and between adjacent antennas 40L to allow the antennas 40V to be interleaved in this way among the antennas 40H in phased antenna array 54-2. When arranged in this way, phased antenna array 54-2 may be provided with polarization diversity in as small an area as possible while still allowing for satisfactory beam forming for each polarization.

Figure 16:
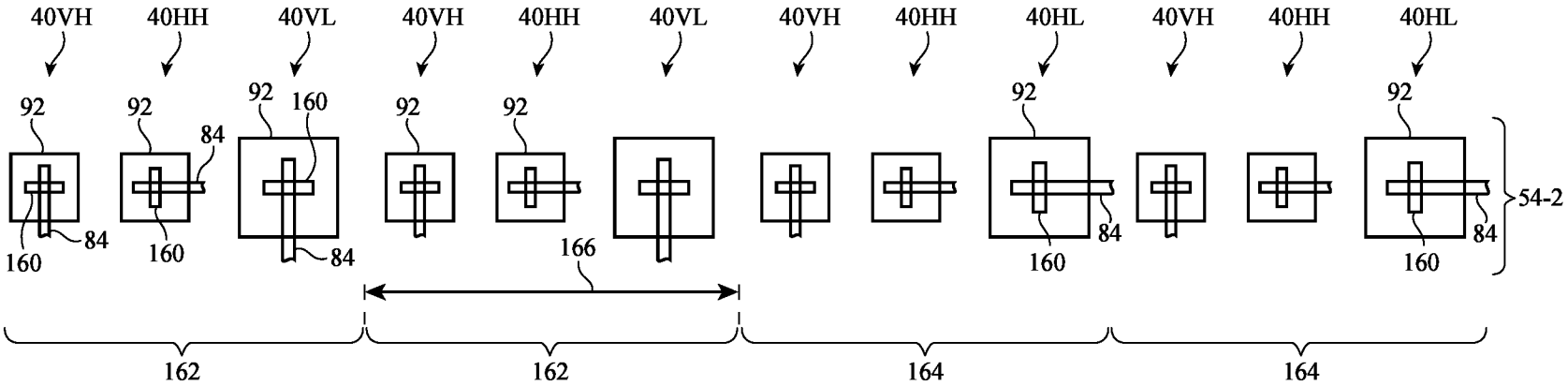
FIG. 16 is a top-down view of an illustrative phased antenna array having interleaved dielectric resonator antennas for handling different frequencies and polarizations in accordance with some embodiments.

In the example of FIG. 15, each antenna in phased antenna array 54-2 covers the same frequency band(s). If desired, phased antenna array 54-2 may include different antennas that cover different frequency bands and/or different polarizations. FIG. 16 is a top-down view of a given phased antenna array 54-2 having different antennas for covering different frequency bands using both horizontal and vertical polarizations.

As shown in FIG. 16, phased antenna array 54-2 may include a first set of antennas 40VH, a second set of antennas 40HH, a third set of antennas 40VL, and a fourth set of antennas 40HL. Antennas 40VH and antennas 40HH may each convey radio-frequency signals in the same relatively high frequency band. Antennas 40VL and antennas 40HL may each convey radio-frequency signals in the same relatively low frequency band. The dimensions of dielectric resonating element 92 and/or slot element 160 in antennas 40VL and 40HL may be larger than the dimensions of dielectric resonating element 92 and/or slot element 160 in antennas 40VH and 40HH in order to support lower frequencies. The relatively low frequency band may, for example, include frequencies between 24 GHz and 31 GHz (e.g., a 28 GHz band), frequencies between 26 GHz and 30 GHz, or any other desired frequencies that are lower than the relatively high frequency band. The relatively high frequency band may, for example, include frequencies between 37 GHz and 41 GHz (e.g., a 39 GHz band), frequencies between 38 GHz and 40 GHz, or any other desired frequencies that are higher than the relatively low frequency band.

Antennas 40VH and 40VL may both convey radio-frequency signals with a first linear polarization (e.g., a vertical polarization). Antennas 40HH and 40HL may both convey radio-frequency signals with an orthogonal second polarization (e.g., a horizontal polarization). Phased antenna array 54-2 of FIG. 16 may include a repeating pattern of one or more unit cells 162 and one or more unit cells 164 of antennas (sometimes referred to herein as antenna unit cells 162 and 164). Each unit cell 162 may include a corresponding antenna 40VH, antenna 40HH, and antenna 40VL. Each unit cell 164 may include a corresponding antenna 40VH, antenna 40HH, and antenna 40HL. In the example of FIG. 16, phased antenna array 54-2 has two unit cells 162 and two unit cells 164. This is merely illustrative and, if desired, phased antenna array 54-2 may have any desired number of two or more unit cells 162 and two or more unit cells 164.

In order to allow for satisfactory beam forming, each antenna 40VH in phased antenna array 54-2 may be located at approximately one-half of the effective wavelength corresponding to a frequency in the relatively high frequency band from one or more adjacent antennas 40VH in phased antenna array 54-2. Similarly, each antenna 40HH may be located at approximately one-half of the effective wavelength corresponding to the frequency in the relatively high frequency band from one or more adjacent antennas 40HH in phased antenna array 54-2. At the same time, each antenna 40VL in phased antenna array 54-2 may be located at approximately one-half of the effective wavelength corresponding to a frequency in the relatively low frequency band from one or more adjacent antennas 40VL in phased antenna array 54-2. Similarly, each antenna 40HL may be located at approximately one-half of the effective wavelength corresponding to the frequency in the relatively low frequency band from one or more adjacent antennas 40HL in phased antenna array 54-2.

As shown in FIG. 16, each antenna 40VH is separated from one or two adjacent antennas 40VH by distance 166, each antenna 40HH is separated from one or two adjacent antennas 40HH by distance 166, each antenna 40VL is separated from one or two adjacent antennas 40VL by distance 166, and each antenna 40HL is separated from one or two adjacent antennas 40HL by distance 166 (e.g., unit cells 162 and 164 may each have a width equal to distance 166). Distance 166 may, for example, be approximately equal to one-half of the wavelength of operation of antennas 40VH and 40HH (e.g., the effective wavelength corresponding to a frequency in the relatively high frequency band of phased antenna array 54-2). As some examples, distance 166 may be between 4 mm and 6 mm, between 4.5 mm and 5.5 mm, between 3 mm and 7 mm, approximately 5 mm, etc. By forming antennas 40VH, 40HH, 40VL, and 40HL as dielectric resonator antennas (rather than as patch or slot antennas), there may be sufficient space to form both an antenna 40HH and one of antennas 40VL or 40HL between each pair of adjacent antennas 40VH. By interleaving the antennas in this way, phased antenna array 54-2 may be provided with polarization diversity for both the first and second frequency bands while occupying as small an area as possible in device 10.

The examples of FIGS. 15 and 16 are merely illustrative. If desired, phased antenna array 54-2 may include antennas arranged in a two-dimensional pattern. When arranged in this way, similar spacing may be provided between antennas of the same polarization and frequency band in the vertical direction as in the horizontal direction shown in FIGS. 15 and 16. For example, adjacent rows of antennas in the phased antenna array may be staggered with respect to each other (e.g., to ensure that vertically-adjacent antennas do not cover the same frequency band and polarization).

Figure 17:
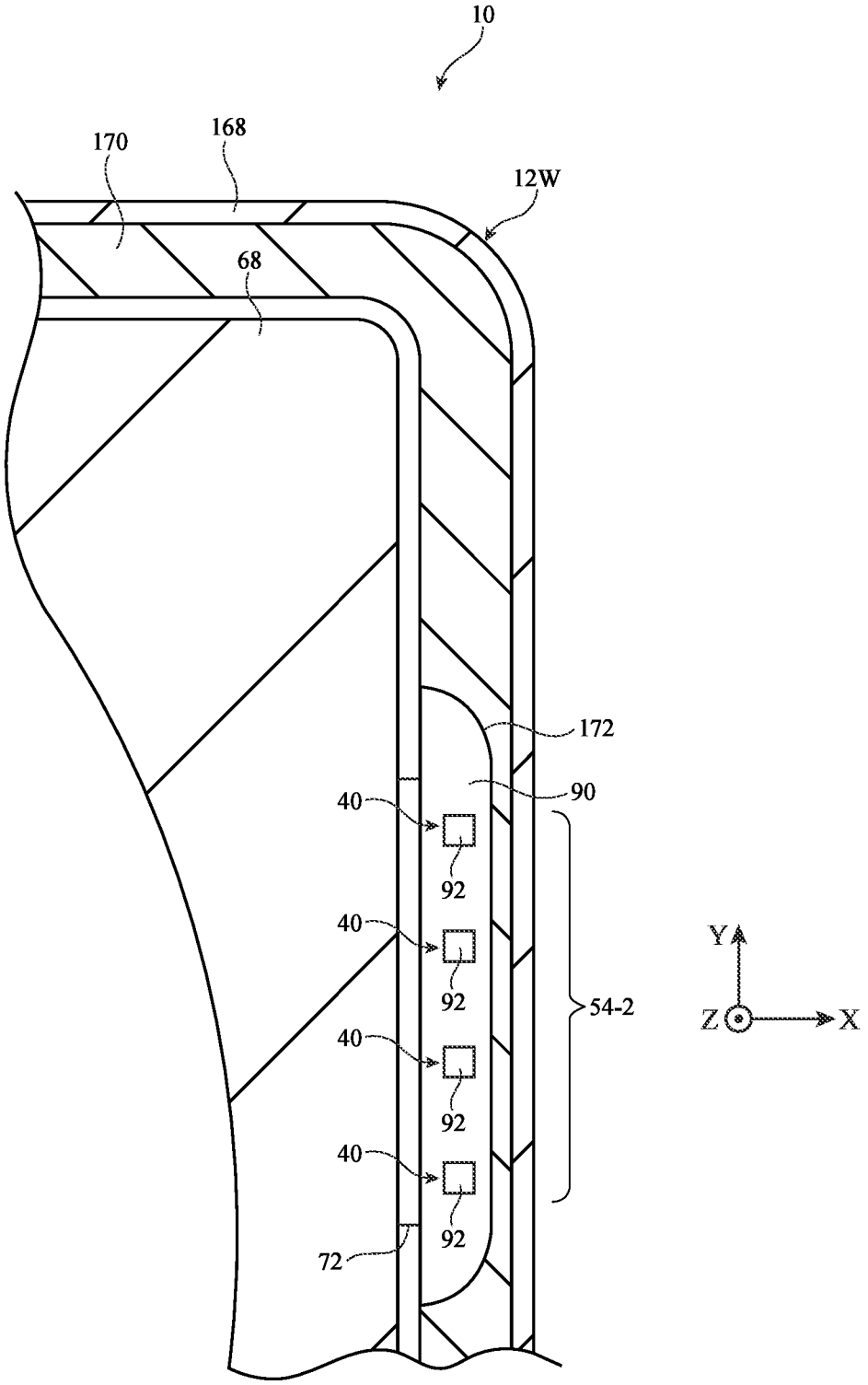
FIG. 17 is a top-down view of an illustrative electronic device having dielectric resonator antennas aligned with a notch in peripheral conductive housing structures in accordance with some embodiments.

One or more phased antenna arrays 54-2 may be mounted at any desired locations in device 10 along the periphery of display 14 for radiating through the display (e.g., within inactive area IA of display 14 of FIG. 1). FIG. 17 is a top-down view of device 10 showing how a given phased antenna array 54-2 may be aligned with a notch in peripheral conductive housing structures 12W.

As shown in FIG. 17, peripheral conductive housing structures 12W may run around the periphery of display module 68 in device 10. Display cover layer 56 of FIGS. 5, 6, and 12 has been omitted from FIG. 17 for the sake of clarity. Peripheral conductive housing structures 12W may include an inwardly protruding lip 170 (sometimes referred to herein as a ledge or datum) and a raised portion 168. Raised portion 168 may run around the peripheral edge of the display cover layer. Lip 170 of peripheral conductive housing structures 12W may include an opening such as notch 172. Phased antenna array 54-2 (e.g., a phased antenna array that covers a single polarization, a phased antenna array that covers multiple polarizations in the same frequency band(s) as shown in FIG. 15, or a phased antenna array that covers multiple polarizations and multiple frequency bands as shown in FIG. 16) may be mounted below lip 170 and aligned with notch 172.

The antennas 40 in phased antenna array 54-2 may each include a dielectric resonating element 92 surrounded by one or more dielectric substrates 90. Each antenna 40 in phased antenna array 54-2 may be fed using a corresponding stripline in the same flexible printed circuit 72. This example is merely illustrative and, if desired, two or more antennas 40 in phased antenna array 54-2 may be fed using radio-frequency transmission lines in separate flexible printed circuits. The antennas 40 in phased antenna array 54-2 may convey radio-frequency signals through notch 172 and the display cover layer (not shown). Phased antenna array 54-2 may perform beam steering within the hemisphere above the front face of device 10. The example of FIG. 17 is merely illustrative. If desired, the antennas 40 in phased antenna array 54-2 may be arranged in a two-dimensional pattern having multiple rows and columns of antennas or in may be arranged in other patterns.

Figure 18:
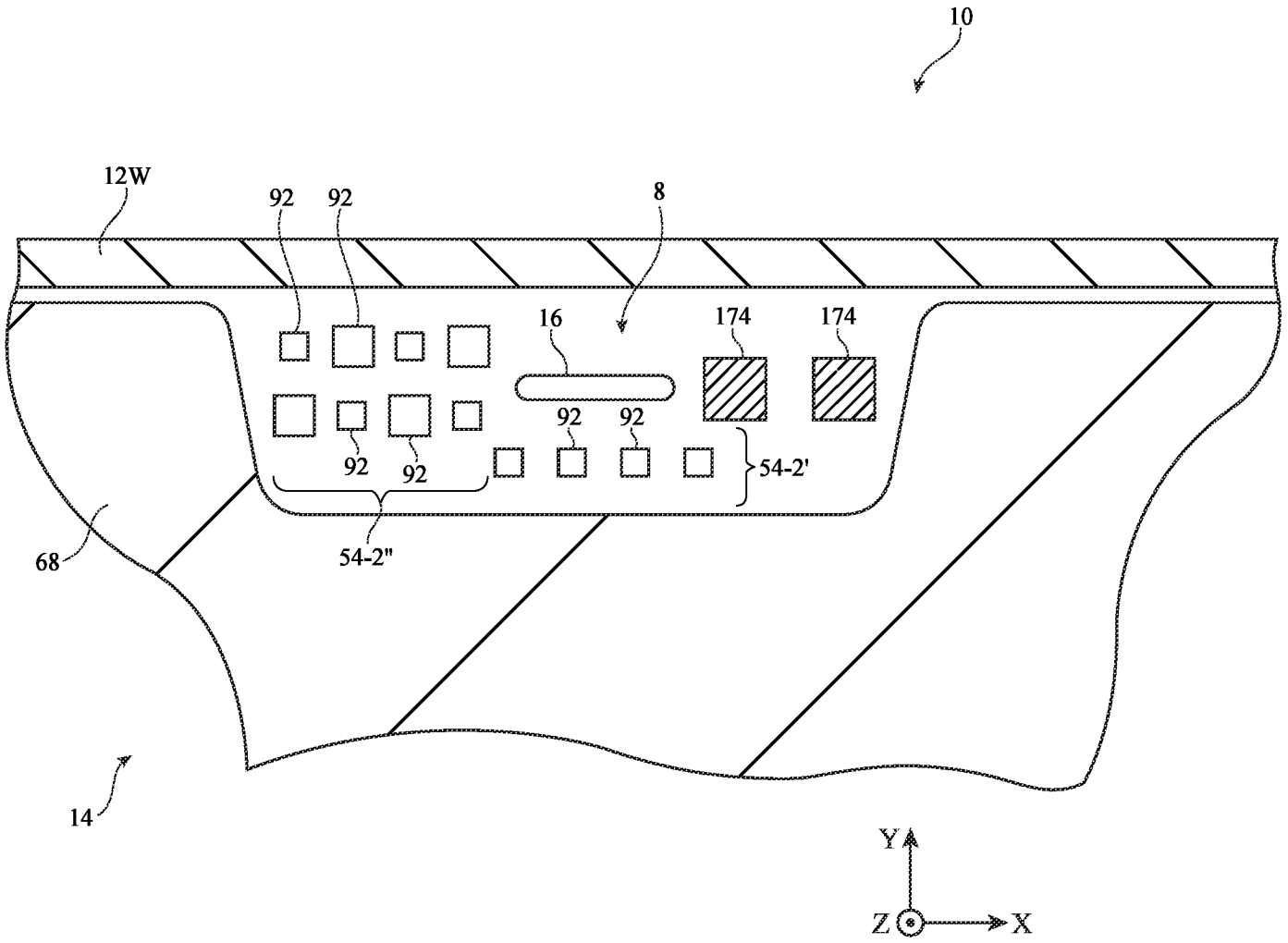
FIG. 18 is a top-down view of an illustrative electronic device having dielectric resonator antennas aligned with a notch in a display module in accordance with some embodiments.

If desired, phased antenna array 54-2 may be located elsewhere within device 10. In one suitable arrangement, phased antenna array 54-2 may be located within notch 8 in active area AA of display 14 (FIG. 1). FIG. 18 is a top-down view showing how phased antenna array 54-2 may be aligned with notch 8 in active area AA of display 14.

As shown in FIG. 18, display module 68 of display 14 may include notch 8. Display cover layer 56 of FIGS. 5, 6, and 12 has been omitted from FIG. 18 for the sake of clarity. Display module 68 may form active area AA of display 14 whereas notch 8 forms part of inactive area IA of display 14 (FIG. 1). The edges of notch 8 may be defined by peripheral conductive housing structures 12W and display module 68. For example, notch 8 may have two or more edges (e.g., three edges) defined by display module 68 and one or more edges defined by peripheral conductive housing structures 12W.

Device 10 may include speaker port 16 (e.g., an ear speaker) within notch 8. If desired, device 10 may include other components 174 within notch 10. Other components 174 may include one or more image sensors such as one or more cameras, an infrared image sensor, an infrared light emitter (e.g., an infrared dot projector and/or flood illuminator), an ambient light sensor, a fingerprint sensor, a capacitive proximity sensor, a thermal sensor, a moisture sensor, or any other desired input/output components (e.g., input/output devices 26 of FIG. 2). One or more phased antenna arrays 54-2 may be aligned with the portion(s) of notch 8 that are not occupied by other components 174 or speaker port 16. Phased antenna arrays 54-2 that are aligned with notch 8 may include one-dimensional phased antenna arrays such as one-dimensional phased antenna array 54-2' and/or two-dimensional phased antenna arrays such as two-dimensional phased antenna array 54-2". Because dielectric resonating elements 92 occupy less lateral area than patch antennas or slot antennas that cover the same frequencies, phased antenna arrays 54-2' and 54-2" may fit within notch 8 and may still exhibit satisfactory antenna efficiency despite the presence of speaker port 16 and other components 174.

If desired, multiple phased antenna arrays 54-2 may be aligned with multiple notches in peripheral conductive housing structures 12W (e.g., multiple notches 172 of FIG. 17) and/or may be aligned with notch 8 in display module 68. Phased antenna arrays 54-2 may provide beam steering in one or more frequency bands between 10 GHz and 300 GHz within some or all of the hemisphere over the front face of device 10. When combined with the operation of phased antenna array 54-1 at the rear of device 10 (FIG. 5), the phased antenna arrays in device 10 may collectively provide coverage within approximately a full sphere around device 10.

The foregoing is merely illustrative and various modifications can be made by those skilled in the art without departing from the scope and spirit of the described embodiments. The foregoing embodiments may be implemented individually or in any combination.

What is claimed is:

1. An electronic device comprising:

a printed circuit;

ground traces on the printed circuit;

a slot in the ground traces;

a dielectric column mounted to the printed circuit and overlapping the slot, wherein the dielectric column has a first dielectric constant;

a dielectric substrate mounted to the printed circuit and laterally surrounding the dielectric column, wherein the dielectric substrate has a second dielectric constant that is less than the first dielectric constant;

a dielectric cover layer overlapping the dielectric column; and a radio-frequency transmission line on the printed circuit and configured to convey radio-frequency signals to the slot at a frequency between 10 GHz and 300 GHz, wherein the slot is configured to excite an electromagnetic resonant mode of the dielectric column, the dielectric column being configured to form a waveguide for the radio-frequency signals that directs the radio-frequency signals through the dielectric cover layer.

2. The electronic device defined in claim 1, further comprising:

a phased antenna array, wherein the dielectric column is embedded in the dielectric substrate and forms part of the phased antenna array, the phased antenna array further comprising:

an additional slot in the ground traces, and an additional dielectric column mounted to the printed circuit, embedded in the dielectric substrate, and overlapping the additional slot, the additional dielectric column being configured to direct additional radio-frequency signals at the frequency through the dielectric cover layer.

3. The electronic device defined in claim 2, further comprising:

peripheral conductive housing structures that extend around a periphery of the electronic device, wherein the dielectric cover layer is mounted to the peripheral conductive housing structures; and a notch in the peripheral conductive housing structures, wherein the phased antenna array is aligned with the notch and configured to convey the radio-frequency signals and the additional radio-frequency signals through the notch.

4. The electronic device defined in claim 2, further comprising:

peripheral conductive housing structures that extend around a periphery of the electronic device, wherein the dielectric cover layer is mounted to the peripheral conductive housing structures;

a display module configured to emit light through the dielectric cover layer, wherein the display module comprises a notch, the notch having edges defined by the display module and the peripheral conductive housing structures;

an audio speaker aligned with the notch; and an image sensor aligned with the notch, wherein the phased antenna array is aligned with the notch and configured to convey the radio-frequency signals and the additional radio-frequency signals through the notch.

5. The electronic device defined in claim 2, wherein the slot and the dielectric column are configured to convey the radio-frequency signals with a first linear polarization, the additional slot and the additional dielectric column being configured to convey the additional radio-frequency signals with a second linear polarization orthogonal to the first linear polarization.

6. The electronic device defined in claim 2, wherein the dielectric column has a first width and the additional dielectric column has second width that is greater than the first width.

7. The electronic device defined in claim 6, wherein the radio-frequency signals are in a first frequency band and the additional radio-frequency signals are in a second frequency band that is lower than the first frequency band.

8. The electronic device defined in claim 1, further comprising:

a housing with a rear housing wall and peripheral conductive housing structures that extend from the rear housing wall to the dielectric cover layer; and a display module that emits light through the dielectric cover layer, wherein the dielectric substrate is mounted against the peripheral conductive housing structures, the printed circuit runs along the rear housing wall, and the dielectric column is configured to convey the radio-frequency signals through a portion of the dielectric cover layer that is interposed between the display module and the peripheral conductive housing structures.

9. The electronic device defined in claim 8, wherein the display module comprises a notch, the notch having edges defined by the display module and the peripheral conductive housing structures; and an image sensor aligned with the notch, wherein the dielectric column is aligned with the notch and is configured to convey the radio-frequency signals through the notch.

10. The electronic device defined in claim 9, further comprising:

an audio component aligned with the notch, wherein the audio component is interposed between the dielectric column and the image sensor.

11. An electronic device comprising:

a printed circuit;

a display;

a dielectric column mounted to the printed circuit, wherein the dielectric column has a first dielectric constant;

a dielectric substrate mounted to the printed circuit and laterally surrounding the dielectric column, wherein the dielectric substrate has a second dielectric constant that is less than the first dielectric constant;

a dielectric cover layer overlapping the display and the dielectric column; and a radio-frequency transmission line on the printed circuit and configured to convey radio-frequency signals at a frequency between 10 GHz and 300 GHz, wherein the dielectric column is configured to form a waveguide for the radio-frequency signals that directs the radio-frequency signals through the dielectric cover layer.

12. The electronic device defined in claim 11, wherein the dielectric cover layer has a third dielectric constant that is less than the first dielectric constant.

13. The electronic device defined in claim 12, further comprising:

a dielectric matching layer interposed between the dielectric column and the dielectric cover layer, wherein the dielectric matching layer has a fourth dielectric constant that is greater than the third dielectric constant and less than the first dielectric constant.

14. The electronic device defined in claim 13, wherein the dielectric matching layer is tapered.

15. The electronic device defined in claim 11, wherein the printed circuit has ground traces and wherein the dielectric column overlaps an opening in the ground traces.

16. The electronic device defined in claim 15, wherein the radio-frequency transmission line is configured to excite an electromagnetic mode of the dielectric column through the opening.

17. An electronic device comprising:

a phased antenna array; and a dielectric cover layer overlapping the phased antenna array, wherein the phased antenna array comprises:

a dielectric substrate;

a first set of dielectric columns laterally surrounded by the dielectric substrate and configured to convey first radio-frequency signals with a first linear polarization through the dielectric cover layer, and a second set of dielectric columns laterally surrounded by the dielectric substrate and configured to convey second radio-frequency signals with a second linear polarization orthogonal to the first linear polarization through the dielectric cover layer.

18. The electronic device defined in claim 17, wherein the dielectric columns in the second set are interleaved among the dielectric columns in the first set.

19. The electronic device defined in claim 17, wherein the phased antenna array further comprises:

a first set of slot antenna resonating elements, wherein each slot antenna resonating element in the first set of slot antenna resonating elements is configured to excite a resonant mode of a different respective dielectric column in the first set of dielectric columns and is further configured to radiate third radio-frequency signals with the first linear polarization through the dielectric cover layer; and a second set of slot antenna resonating elements, wherein each slot antenna resonating element in the second set of slot antenna resonating elements is configured to excite a resonant mode of a different respective dielectric column in the second set of dielectric columns and is further configured to radiate fourth radio-frequency signals with the second linear polarization through the dielectric cover layer.

20. The electronic device defined in claim 17, wherein the first set of dielectric columns is configured to convey the first radio-frequency signals at a first frequency between 10 GHz and 300 GHz, the second set of dielectric columns is configured to convey the second radio-frequency signals at the first frequency, and the phased antenna array further comprises:

a third set of dielectric columns configured to convey third radio-frequency signals at a second frequency and with the first linear polarization through the dielectric cover layer, wherein the second frequency is greater than 10 GHz and less than the first frequency;

a fourth set of dielectric columns configured to convey fourth radio-frequency signals at the second frequency and with the second linear polarization through the dielectric cover layer;

a repeating pattern of first antenna unit cells, wherein each of the first antenna unit cells comprises a first dielectric column from the first set, a second dielectric column from the third set, and a third dielectric column from the second set that is interposed between the first and second dielectric columns; and a repeating pattern of second antenna unit cells, wherein each of the second antenna unit cells comprises a fourth dielectric column from the first set, a fifth dielectric column from the fourth set, and a sixth dielectric column from the second set that is interposed between the fourth and fifth dielectric columns.

* * * * *